US010830011B2

(12) United States Patent
MacKenzie et al.

(10) Patent No.: US 10,830,011 B2
(45) Date of Patent: Nov. 10, 2020

(54) SELECTIVE DOWNHOLE ACTUATOR

(71) Applicant: NOV DOWNHOLE EURASIA LIMITED, Gloucestershire (GB)

(72) Inventors: Alan MacKenzie, Aberdeenshire (GB); Alagappan Viswanathan, Aberdeenshire (GB); Alastair Henry Walter MacFarlane, Angus (GB)

(73) Assignee: NOV Downhole Eurasia Limited (GB)

( * ) Notice: Subject to any disclaimer, the term of this patent is extended or adjusted under 35 U.S.C. 154(b) by 301 days.

(21) Appl. No.: 15/557,352

(22) PCT Filed: Feb. 19, 2016

(86) PCT No.: PCT/GB2016/050416

§ 371 (c)(1),
(2) Date: Sep. 11, 2017

(87) PCT Pub. No.: WO2016/132140

PCT Pub. Date: Aug. 25, 2016

(65) Prior Publication Data

US 2018/0238131 A1 Aug. 23, 2018

(30) Foreign Application Priority Data

Feb. 19, 2015 (GB) ..... 1502803.8

(51) Int. Cl.
*E21B 23/00* (2006.01)
*E21B 10/32* (2006.01)

(52) U.S. Cl.
CPC ..... *E21B 23/006* (2013.01); *E21B 10/32* (2013.01)

(58) Field of Classification Search
CPC combination set(s) only.
See application file for complete search history.

(56) References Cited

U.S. PATENT DOCUMENTS

| | | | |
|---|---|---|---|
| 4,273,464 | A | 6/1981 | Scott |
| 4,782,897 | A | 11/1988 | Zeller |
| 4,913,231 | A | 4/1990 | Muller et al. |
| 5,483,987 | A | 1/1996 | Amaudric du Chaffaut et al. |
| 5,529,126 | A | 6/1996 | Edwards |

(Continued)

FOREIGN PATENT DOCUMENTS

| | | | |
|---|---|---|---|
| AU | 2012286996 | A1 | 1/2014 |
| CA | 2093331 | C | 8/2001 |
| WO | 2004088091 | A1 | 10/2004 |

OTHER PUBLICATIONS

European Extended European Search Report dated Mar. 29, 2019 for Application No. EP18193558.6.

(Continued)

*Primary Examiner* — Taras P Bemko
*Assistant Examiner* — Ronald R Runyan
(74) *Attorney, Agent, or Firm* — Conley Rose, P.C.

(57) ABSTRACT

A selective downhole actuator comprising at least a first actuator position, a second actuator position and a third actuator position. The selective downhole actuator is reconfigurable between the first actuator position and the second actuator position. The selective actuator is selectively reconfigurable to the third actuator position by varying an operating parameter during a transition of the selective downhole actuator between the first and second actuator positions.

24 Claims, 16 Drawing Sheets

Position 2. Flow on.
The Driving Piston over-rides the Return spring, moving the Mandrel downwards. The J Slot and J Pin rotates the Mandrel until it no-go's.

(56) References Cited

U.S. PATENT DOCUMENTS

| | | | | |
|---|---|---|---|---|
| 5,857,710 | A | 1/1999 | Leising et al. | |
| 6,230,807 | B1 * | 5/2001 | Patel | E21B 23/006 166/321 |
| 6,550,540 | B2 | 4/2003 | Trent | |
| 6,899,179 | B2 | 5/2005 | McGarian et al. | |
| 6,948,561 | B2 | 9/2005 | Myron | |
| 7,168,493 | B2 | 1/2007 | Eddison | |
| 7,347,273 | B2 | 3/2008 | George et al. | |
| 7,357,198 | B2 | 4/2008 | Mcgarian et al. | |
| 7,584,800 | B2 | 9/2009 | Heath et al. | |
| 9,683,434 | B2 | 6/2017 | Machocki | |
| 10,190,376 | B2 | 1/2019 | Machocki | |
| 2007/0295514 | A1 | 12/2007 | Rohde et al. | |
| 2008/0314600 | A1 | 12/2008 | Howard et al. | |
| 2009/0044944 | A1 | 2/2009 | Murray et al. | |
| 2011/0011597 | A1 | 1/2011 | Fay | |
| 2011/0048723 | A1 | 3/2011 | Edwards | |
| 2011/0315390 | A1 | 12/2011 | Guillory et al. | |
| 2012/0055671 | A1 | 3/2012 | Stromquist et al. | |
| 2012/0186817 | A1 | 7/2012 | Gibson et al. | |
| 2012/0205108 | A1 | 8/2012 | Stang | |
| 2013/0105172 | A1 * | 5/2013 | Swenson | E21B 23/006 166/370 |
| 2013/0118758 | A1 | 5/2013 | Caminari | |
| 2014/0008071 | A1 | 1/2014 | Patterson et al. | |
| 2014/0144642 | A1 | 5/2014 | Lindsay et al. | |

OTHER PUBLICATIONS

International Search Report and Written Opinion dated May 12, 2016, for Application No. PCT/GB2016/050416 filed Feb. 19, 2016.

* cited by examiner

A Selective Downhole Tool Actuator

DOWNHOLE TOOL ACTUATOR
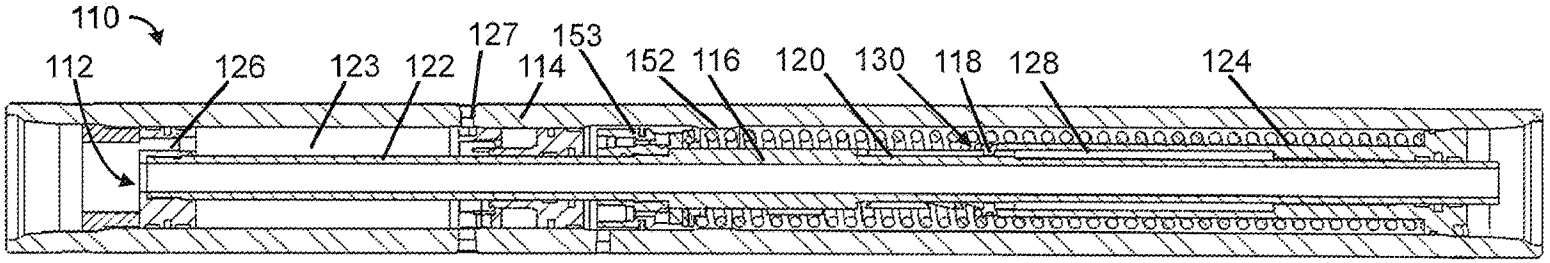
Fig.3 NO FLOW - TOOL CLOSED
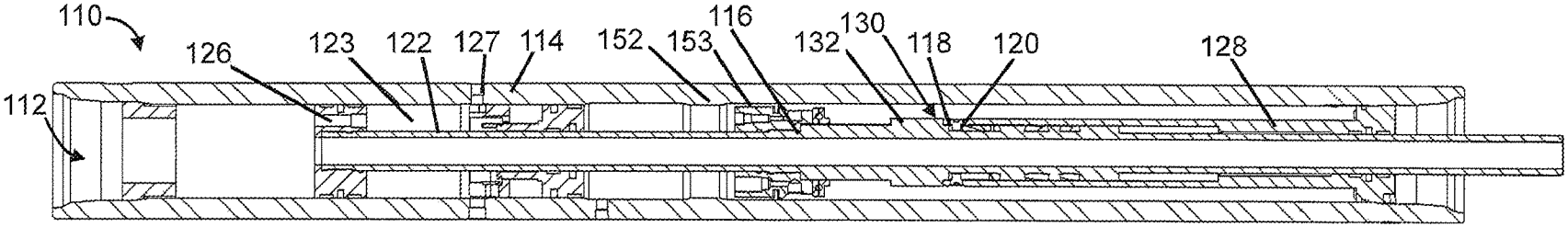
Fig.4 FLOW ON - SHORT STROKE - NOT ACTUATED
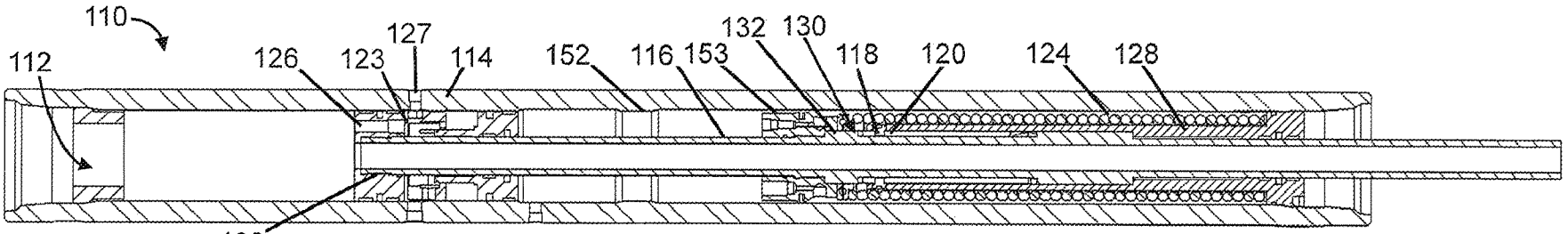
Fig.5 FLOW ON - LONG STROKE - TOOL ACTUATED Tool overview. Housing and the return spring omitted for clarity Position 1. Flow off.
The return spring maintains the Mandrel in the fully up position.

Position 2. Flow on.
The Driving Piston over-rides the Return spring, moving the Mandrel downwards. The J Slot and J Pin rotates the Mandrel until it no-go's.

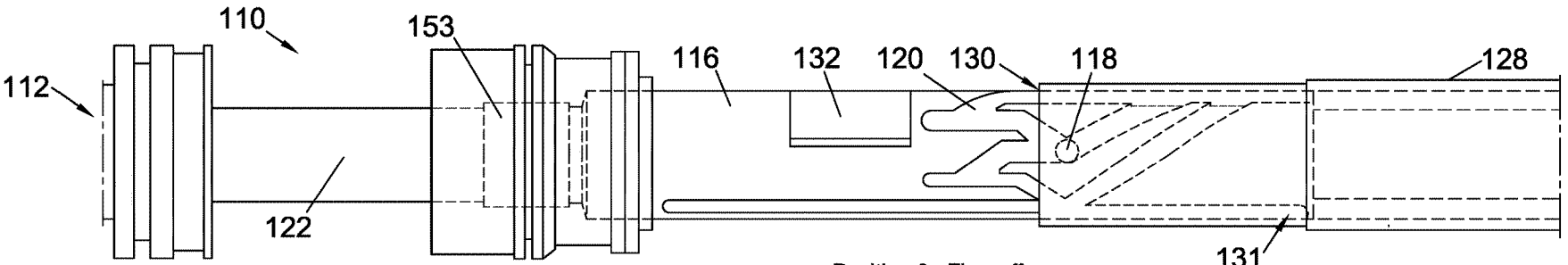

Position 3. Flow off.
The Return Spring moves the Mandrel upwards. The Oriface Control Valve starts to choke flow in the chamber slowing the travel of the Mandrel

Fig.9

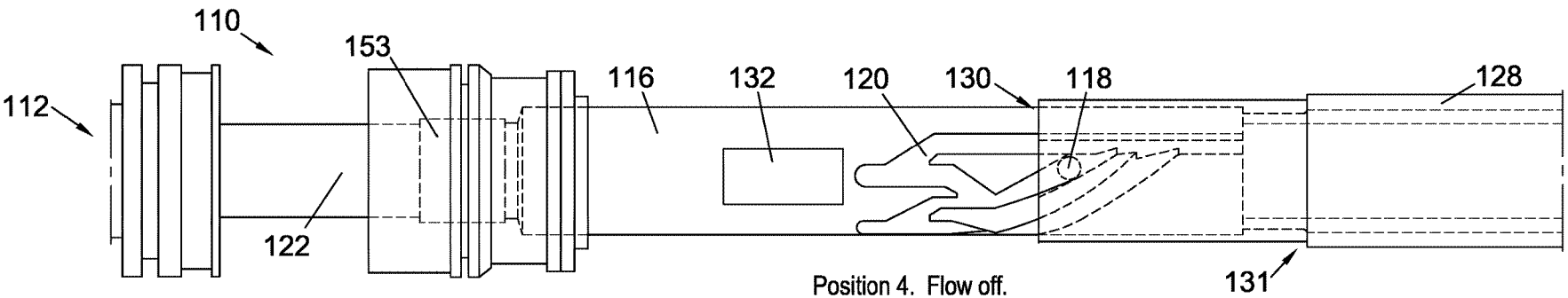

Position 4. Flow off.
The Oriface Control Valve ceases to choke flow allowing Mandrel to move as normal.

Fig.10

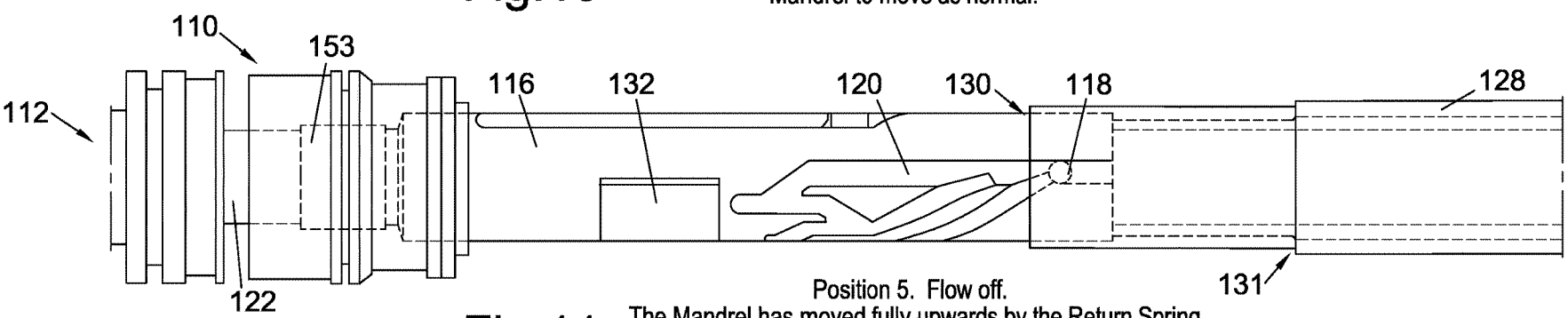

Position 5. Flow off.
The Mandrel has moved fully upwards by the Return Spring to the default start position ( as position 1).

Fig.11

Position 6. Flow on.
The Mandrel returns to the same position as in 2 above.

Position 7. Flow off.
During the choked portion of the Piston travel, if the flow is turned on, then J pin / J slot will move to the next, short stroke, no-go position (8 below).

Position 8. Flow on.

Position 9. Flow off.
Similar to 7 above, if the flow is turned on during the choked travel section, the J Pin / J slot will move to the next position (10 below).

Position 10. Flow on.
The Mandrel enters the long stroke; tool is actuated

Position 11. Flow off.
The Mandrel returns to the default start position (as in Position 1).

J slot profile on 2D (not to scale)

SELECTIVE DOWNHOLE ACTUATOR

CROSS-REFERENCE TO RELATED APPLICATIONS

This application is a 35 U.S.C. § 371 national stage application of PCT/GB2016/050416 filed Feb. 19, 2016, entitled "Selective Downhole Actuator," which claims priority to United Kingdom application No. GB 1502803.8 filed on Feb. 19, 2015, both of which are incorporated herein by reference in their entirety for all purposes.

FIELD

Embodiments described herein relate generally to a selective downhole actuator, and associated methods; and in particular, but not exclusively, to a downhole indexer, such as for cycling between actuator positions.

BACKGROUND

In the oil and gas industry, downhole tools are used to perform various operations during exploration, production, maintenance or decommissioning. The tools often form part of a tool string that travels downhole, such as a drill string for drilling a bore in an underground formation. Typically the downhole tools perform different functions during different stages of downhole operations. For example, downhole tools are often transported to and from a particular location in a bore and only activated for use at the particular location for a specific interval, such as to perform a local operation such as packing or reaming or perforating, or the like. Downhole tools are run in downhole on strings, such as drill strings, work strings, coil tubing strings, or the like. Many downhole operations require the actuation of equipment in downhole locations at specific phases or positions of downhole operations.

It is often unsuitable to transport the downhole tools in an active configuration. For example, there are numerous downhole tools that feature radially extendable members. Blades or cutters such as on an underreamer are radially extendable to allow the underreamer to pass through a restriction or a casing with the blades in a relatively compact radial configuration. When the underreamer passes out of the end of the casing in a bore, the blades are extended to allow the bore to be drilled to a diameter greater than the internal diameter of the casing.

During an underreaming operation the blades can be subjected to high radial forces so, to ensure effective cutting, the blades are radially supported in the extended configuration. Upon completion of an underreaming operation, the blades are retracted to allow the toolstring including the underreamer to be retrieved from the bore. Failure to retract the blades, or to retain the blades in a retracted configuration during retrieval of the underreamer, causes the blades to contact the existing casing. A blade retraction failure of the underreamer makes it difficult, sometimes impossible, to retrieve the underreamer and can also cause damage to the casing or other equipment in the bore.

Actuation or deactuation of tools, including under-reamers, downhole is achieved through various means. For example, downhole actuation may occur at a predetermined location such as a depth or relative to other downhole apparatus or features, such as when a tool being run-in reaches a previously-positioned tool or feature. Other forms of downhole actuation involve remote actuation, such as from surface. Forms of remote actuation from surface include the use of drop-balls or darts transported by fluid in a bore, pressure pulses or variations in properties of a fluid transported in a bore, hydraulic control by hydraulic lines, or signals sent by other means from surface, such as electric or light (e.g. via fibre-optic).

SUMMARY

According to a first aspect there are provided at least some embodiments of a selective downhole actuator. The selective downhole actuator may comprise at least a first actuator position, a second actuator position and a third actuator position. The selective downhole actuator may be reconfigurable between the first actuator position and the second actuator position. The selective actuator may be selectively reconfigurable to the third actuator position by varying an operating parameter during a transition of the selective downhole actuator between the first and second actuator positions.

The selective downhole actuation tool may comprise a downhole indexer. The first actuator position may comprise a first indexing position. The second indexing position may comprise a second indexing position. The third actuator position may comprise a third indexing position. The selective downhole actuator may be reconfigurable between the indexing positions by indexing. Reconfiguring may comprise indexing. Accordingly, the indexer may be selectively indexable to the third indexing position by varying an operating parameter during a transition of the indexer between the first and second indexing positions.

The selective downhole actuator may be fluid-actuated. The selective downhole actuator may comprise a selective downhole tool actuator.

The selective downhole actuator may be directly reconfigurable between the first actuator position and the second actuator position. The selective downhole actuator may be selectively reconfigurable to the third actuator position only by varying the operating parameter during the transition of the selective downhole actuator between the first and second actuator positions. The selective downhole actuator may be selectively reconfigurable to the third actuator position by varying the operating parameter only during the transition of the selective downhole actuator between the first and second actuator positions. The selective downhole actuator may be selectively reconfigurable to the third actuator position by varying the operating parameter during the transition of the selective downhole actuator from the first actuator position towards the second actuator position. The selective downhole actuator may be selectively reconfigurable to the third actuator position instead of to the second actuator position. The selective downhole actuator may be selectively reconfigurable to the third actuator position instead of directly to the second actuator position. The selective downhole actuator may be selectively reconfigurable to the third actuator position by varying the operating parameter only during the transition of the selective downhole actuator from the first actuator position to the second actuator position. The selective downhole actuator may not be reconfigurable to the third actuator position by varying the operating parameter during a transition of the selective downhole actuator from the second actuator position to the first actuator position. The selective downhole actuator may be selectively reconfigurable to the third actuator position by selectively varying the operating parameter. The selective downhole actuator may be selectively reconfigurable to the third actuator position by selectively varying the operating parameter during the transition according to a first predetermined pattern, sequence or procedure.

The third actuator position may comprise an optional actuator position, selectable by the selective variation of the operating parameter. The third actuator position may comprise an optional actuator position, selectable by varying the operating parameter according to the predetermined pattern, sequence or procedure.

The selective downhole actuator may be reconfigurable from the second actuator position to the first actuator position. The selective downhole actuator may be cyclable between the first and second actuator positions. The selective downhole actuator may be endlessly cyclable between the first and second actuator positions. The selective downhole actuator may be cyclable between the first and second positions without indexing to the third position. The selective downhole actuator may be endlessly cyclable between the first and second positions without indexing to the third position. The selective downhole actuator may be cyclable between the first and second positions and only reconfigurable to the third position upon the active selection of the third actuator position.

The selective downhole actuator may be cyclable to the third actuator position. The selective downhole actuator may be endlessly cyclable to the third actuator position. The selective downhole actuator may be endlessly cyclable to the third actuator position by varying the operating parameter according to the predetermined pattern, sequence or procedure.

The selective downhole actuator may be configured to transition by default to a particular actuation state. The selective downhole actuator may be configured to always transition by default to the particular actuation state, such as to always transition to the particular actuation state in a particular condition, such as whenever subjected to a particular operating parameter condition.

The default actuation state may correspond to a default actuation position. The default actuation position may comprise a default axial and/or rotational actuation position.

The actuator may comprise a plurality of default positions, each comprising a same axial position. The actuator may comprise a plurality of default positions, each comprising a same rotational position. The actuator may return to a particular default position of the plurality of default positions dependent upon the actuation position from where the actuator is transitioning under the default conditions. For example, where the actuator is defaulting to a non-actuating state under no flow or low fluid pressure from the first actuation position, the actuator may default to the second actuation position, such as the initial or starting position; and where the actuator is defaulting to a non-actuating state under no flow or low fluid pressure from the third actuation position, the actuator may default to a further second actuation position, such as a further second actuation position rotationally arranged relative to the initial or starting second position.

The default actuation state or position may comprise a non-actuating default state. Accordingly, the actuator may be configured to always default to a non-actuating state under the particular operating parameter condition.

In alternative embodiments, the default actuation state or position may comprise an actuated or actuating state. Accordingly, the actuator may be configured to always default to an actuated actuating state under the particular operating parameter condition. For example, where it is desired that the selective downhole actuator is used to only selectively deactivate a tool, such as to selectively close or deactivate a valve, the default state may be activate or maintain activated the tool.

The selective downhole actuator may transition from the first position to the second position by default. The selective downhole actuator may transition from the first configuration directly to the second position by default. The selective downhole actuator may transition from the first position to the second position in the absence of the selection of variation of the operating parameter to transition to the third position. The selective downhole actuator may selectively transition from the first actuator position to the third actuator position. The selective downhole actuator may selectively transition from the first actuator position directly to the third actuator position, such as without transitioning via the second actuator position.

The selective downhole actuator may be selectively reconfigurable to the third actuator position by the variation of the operating parameter during a particular phase or portion of the transition from the first actuator position to the second actuator position. The particular phase or portion may correspond to a window, such as a time and/or travel window. At least a portion of the transition from the first actuator position to the second actuator position may provide the window for selectively accessing the third actuator position.

The transition from the first actuator position to the second actuator position may be extended or prolonged. For example, the transition from the first actuator position to the second actuator position may be extended or prolonged relative to a conventional transition of a selective downhole actuator between actuator positions. The transition from the first actuator position to the second actuator position may be extended or prolonged relative to a transition from the second actuator position to the first actuator position. The transition from the first actuator position to the second actuator position may be extended or prolonged in time and/or distance, such as in time and/or distance of transit between positions.

The selective downhole actuator may comprise a primary path defining the transition from the first position to the second position. The selective downhole actuator may comprise a secondary path defining or at least providing access to the third actuator position. The secondary path may be accessible from the primary path. The secondary path may be accessible from the primary path by the selective variation of the operating parameter. The primary path may comprise a junction or intersection for accessing the secondary path. The secondary path may comprise a branch path from the primary path. The secondary path may allow for the selection of transition from the first position to the third position. The secondary path may allow for the transition from the first position directly to the third position, such as without transitioning via the second position. The secondary path may only be accessible during the window portion of transition along the primary path from the first actuator position towards the second actuator position. The window portion may comprise at least a portion of the primary path between the junction or intersection and the second actuator position. The window portion may exclude the second actuator position. The secondary path may not be directly accessible from the second actuator position. The secondary path may only be accessible from the second actuator position via the first actuator position.

The window portion of the primary path may extend in a first direction from the first actuator position towards the second actuator position. The first direction may define or correspond to the direction of transition or movement of the selective downhole actuator from the first actuator position towards the second actuator position. The secondary path may extend in a second direction, the second direction being different from the first direction. The second direction may be axially opposite the first direction. Additionally, or alternatively, the second direction may be rotationally or radially or circumferentially opposite the first direction, such as counter-clockwise versus clockwise.

The secondary path may be accessible by reversing at least a portion of the transition along the primary path. The secondary path may be accessible by transitioning along the primary path back towards the first actuator position. The selective downhole actuator may be configured such that the third actuator position is accessed by reversing the direction of transition or movement of the selective downhole actuator between the first and second positions. The selective downhole actuator may be configured such that the third actuator position is accessed by reversing the direction of transition or movement of the selective downhole actuator between the first and second positions during the transition of the selective downhole actuator from the first actuator position towards the second actuator position. The secondary path may become the default path when the operating parameter is selectively varied during the window portion of the transition from the first actuator position towards the second actuator position.

The selective downhole actuator may comprise a main path between the second actuator position and the first actuator position. The main path and the primary path may define a circuit. The main path may comprise a default path from the second actuator position towards the first actuator position.

The main path may comprise a stroking or extension path from the second actuator position to the first actuator position. The primary path may comprise a return path from the first actuator position to the second actuator position.

At least a portion of at least the transition from the first actuator position to the second actuator position may be damped. At least a portion of the window for selectively accessing the third actuator position may be damped. The window for selectively accessing the third actuator position may at least overlap with the damped portion of the transition. Optionally, all of the window and/or all of the transition from the first actuator position to the second actuator position may be damped.

Damping the at least a portion of the transition from the first actuator position to the second actuator position may provide for a prolonged or extended window for selectively accessing the third actuator position. The window may comprise a time window. The window may comprise a travel window, such as of longitudinal and/or rotational travel. The prolonged or extended window may comprise sufficient time to distinguishably establish variation in the operating parameters. For example, the window may provide for sufficient time and/or travel to sufficiently decrease fluid pressure and/or flow to transition along at least a portion of the primary path and then to sufficiently increase fluid pressure and/or flow to reverse transition along the at least a portion of the primary path, such as to access the secondary or branch path. The window may provide for sufficient time and/or travel to establish that fluid pressure and/or flow has decreased sufficiently and/or to establish that fluid pressure and/or flow has been sufficiently increased to access the secondary or branch path. For example, the window may provide sufficient time to receive feedback on the operating parameter, such as the fluid pressure and/or flow.

The window may provide for a minimum time period. The window may provide for a period of at least one minute. The window may provide for a period of at least two minutes. The window may provide for a period of at least three minutes. The window may provide for a period of at least five minutes. The window may provide for a period of at least ten minutes. The window may provide for a period of at least twenty minutes. The window may provide for a period of at least thirty minutes.

The window may provide for a maximum time period. The window may provide for a maximum period of twenty minutes or less. The window may provide for a maximum period of ten minutes or less. The window may provide for a maximum period of eight minutes or less. The window may provide for a maximum period of six minutes or less. The window may provide for a maximum period of five minutes or less. Providing a minimum time period for the window may prevent inadvertent access to the secondary or branch path. For example, the minimum time period may prevent the undesired indexing towards an actuated actuator state (e.g. of the third actuator position) such as due to a short, temporary interruption in the operating parameters, such as due to a fluid pressure or flow fluctuation, such as due to a valve opening or closing or a pump briefly pausing. Providing a maximum window period may allow for the reversion to or instigation of the first operating parameter value without undesired indexing towards an actuated actuator state (e.g. of the third actuator position). For example, the first operating parameter value may be re-engaged after the maximum window has been exceeded. For example, the fluid pressure and/or flow may be turned on or increased after the maximum window, without undesired indexing towards an actuated actuator state (e.g. of the third actuator position).

The prolonged window may provide for additional or alternative functionality of the actuator. For example, the prolonged window may provide for an ability or an increased ability to access the third actuation position.

The prolonged window may effectively define an additional actuation position. For example, the prolonged window may provide a transitional actuation position between the first and second actuation positions and/or between the third and second actuation positions.

The prolonged window may effectively define an additional actuation position in the form of a transitional actuation position between an actuating position and a non-actuating position. The transitional actuation position may define an additional actuation state. The prolonged window may provide an alternative to holding an actuator at an intermediate or transitional axial position, such as holding by maintaining an intermediate fluid pressure or fluid flow to maintain an intermediate position.

Damping at least a portion of at least the transition from the first actuator position to the second actuator position may at least reduce stresses and/or strains, such as may be associated with impact and/or higher velocity or undamped transitions or movements.

The damped portion of transition may provide an extended period of time between actuation positions that may be utilised in alternative or additional applications. For example, the damped portion may provide a sufficient period of time to define an intermediate actuation position. That intermediate actuation position may define an additional or intermediate actuation state or function. For example, that intermediate position may correspond to a further actuation state, such as to define an additional state or function of a tool or member actuatable by the actuator. For example, the damped portion may correspond to an intermediate state of a valve, which may be held in an intermediate state (e.g. partially open) between two other states (e.g. fully closed and fully open), at least for the duration of the damped period of transition. Other applications may include the use of the damped portion to provide an intermediate position of a tool, member or element associated with the actuator, such as an intermediate extension position of a member (e.g. a cutter).

The first actuator position may comprise a non-actuating position.

The second actuator position may comprise a non-actuating position.

The second actuator position may correspond to a neutral, starting, return or no-flow or low-flow position.

The third actuator position may comprise an actuating position.

The first actuator position may correspond to a first short stroke position. The second actuator position may correspond to a no-stroke and/or return stroke position. The second actuator position may correspond to an initial actuator position. For example the second actuator position may comprise the initial actuator position, such as prior to run-in and/or prior to fluid pressurisation. The short stroke position/s may correspond to an inactive actuator position/s.

The third actuator position may correspond to a long stroke position.

The third actuator position may correspond to an open stroke position.

The actuator may be biased towards one or more of the actuation positions.

The actuator may be axially and/or rotationally biased.

The actuator may be biased towards a neutral, starting, return or no-flow or low-flow position.

The actuator may be hydraulically and/or mechanically biased. For example, the actuator may comprise a spring and/or a hydraulic biasing piston. The hydraulic biasing piston may be in fluid communication with an internal fluid, such as in the throughbore and/or with an external fluid, such as in an annulus external to the actuator. The actuator may comprise a spring, such as for axial and/or rotationally biasing.

The selective downhole actuator may be cyclable, such as endlessly cyclable, between actuator positions corresponding to a same actuator state. The selective downhole actuator may be cyclable directly between actuator positions corresponding to the same actuator state. The selective downhole actuator may be cyclable, such as endlessly cyclable, indirectly between actuator positions corresponding to a same actuator state. The actuator positions corresponding to the same actuator state may be actuator positions corresponding to the same or similar operating parameters and/or actuator positions corresponding to the different operating parameters.

Where the selective downhole tool comprises a downhole indexer, the/each actuator state may comprise an indexing state.

The selective downhole actuator may be cyclable between a first actuator position corresponding to the first actuator state and a further actuator position corresponding to the first actuator state by moving in opposite axial and/or rotational direction/s. The selective downhole actuator may be cyclable between the first and second actuator positions by moving in opposite axial and/or rotational direction/s. For example, the first portion of the selective downhole actuator may move relative to the second portion of the selective downhole actuator in a first axial direction to transition from the first actuator position to the second actuator position. The first portion of the selective downhole actuator may move relative to the second portion of the selective downhole actuator in a second axial direction to transition from the second actuator position to the first actuator position. The second axial direction may be opposite to the first axial direction. For example, the first axial direction may be downhole and the second axial direction may be uphole (or vice versa). The first portion of the selective downhole actuator may move relative to the second portion of the selective downhole actuator in a first rotational direction to transition from the first actuator position to the second actuator position. The first portion of the selective downhole actuator may move relative to the second portion of the selective downhole actuator in a first rotational direction to transition from the first actuator position to the second actuator position. The first portion of the selective downhole actuator may move relative to the second portion of the selective downhole actuator in a second rotational direction to transition from the second actuator position to the first actuator position. The second rotational direction may be opposite to the first rotational direction. For example, the first rotational direction may be clockwise and the second rotational direction may be counter-clockwise (or vice versa).

The selective downhole actuator may be configured to alternate or oscillate rotational direction during sequential indexing. The selective downhole actuator may be configured to only complete a partial revolution during sequential indexing. The selective downhole actuator may be configured to only complete a partial revolution throughout operation during all sequencing, such as during endless cycling.

Alternatively, the selective downhole actuator may be configured to continually or continuously rotate in substantially the same direction during sequential sequencing. The selective downhole actuator may be configured to complete a revolution/s during sequential sequencing. The selective downhole actuator may be configured to complete endless revolutions during endless cycling. The selective downhole actuator may comprise a path that extends continuously around a circumference. The path may define an endless circumferential path. The path may be defined that the path may be endlessly followed by repeated revolutions in the same rotational direction.

The selective downhole actuator may be configured to index to the second actuator position from the third actuator position. The selective downhole actuator may be configured to index directly to the second actuator position from the third actuator position. The selective downhole actuator may comprise a second primary path extending from the third actuator position towards the second actuator position.

The selective downhole actuator may be selectively indexed between the first and second actuator positions. The selective downhole actuator may be selectively indexed between the first and third actuator positions. The selective downhole actuator may be selectively indexed between the third and second actuator positions. The selective downhole actuator may be selectively indexed from the first to the second actuator position. The selective downhole actuator may be selectively indexed directly from the first to the second actuator position. The selective downhole actuator may be selectively indexed from the second to the first actuator position. The selective downhole actuator may be selectively indexed directly from the second to the first actuator position. The selective downhole actuator may be selectively indexed from the second to the third actuator position. The selective downhole actuator may be selectively indexed indirectly from the second to the third actuator position. The selective downhole actuator may be selectively indexed from the second to the third actuator position via the first actuator position. The selective downhole actuator may be selectively indexed from the second to the third actuator position only via the first actuator position. The selective downhole actuator may be selectively indexed from the third to the second actuator position. The selective downhole actuator may be selectively indexed directly from the third to the second actuator position.

The downhole selective downhole actuator may be reconfigurable between the first actuator position and the second actuator position. The downhole selective downhole actuator may be reconfigurable from the first actuator position to the second actuator position. The downhole selective downhole actuator may be reconfigurable from the first actuator position to the second actuator position by relative movement between a first portion of the selective downhole actuator and a second portion of the selective downhole actuator. Reconfiguring the downhole selective downhole actuator may comprise transitioning the downhole selective downhole actuator between positions. For example, reconfiguring the downhole selective downhole actuator from the first actuator position to the second actuator position may comprise transitioning from the first position to the second position. The downhole selective downhole actuator may be selectively reconfigurable to the third actuator position. The downhole selective downhole actuator may be selectively reconfigurable to the third actuator position by the selective variation of the operating parameter. The downhole selective downhole actuator may be selectively reconfigurable to the third actuator position by the selective variation of the operating parameter during the transition from the first position to the second position. The downhole selective downhole actuator may be selectively reconfigurable to the third actuator position only by the selective variation of the operating parameter during the transition from the first position to the second position.

The downhole selective downhole actuator may be reconfigurable from the first to the second actuator positions along the primary path. The downhole selective downhole actuator may be reconfigurable from the second to the first actuator positions along the main path.

The downhole selective downhole actuator may be reconfigurable between the first actuator position and the second actuator position according to the variation in the operating parameter. The operating parameter for reconfiguring the downhole selective downhole actuator between the first and second actuator positions may comprise the same operating parameter for selectively reconfiguring the downhole selective downhole actuator to the third actuator position. The downhole selective downhole actuator may be reconfigurable from the first actuator position to the second actuator position by setting the operating parameter at a first value. The downhole selective downhole actuator may be transitioned from the first actuator position to the second actuator position by varying the operating parameter to the first value. The downhole selective downhole actuator may be reconfigurable from the second actuator position to the first actuator position by setting the operating parameter at a second value. The downhole selective downhole actuator may be transitioned from the second actuator position to the first actuator position by varying the operating parameter to the second value. The downhole selective downhole actuator may be reconfigurable from the first actuator position to the third actuator position by setting the operating parameter at a third value during the transition from the first actuator position towards the second actuator position. The downhole selective downhole actuator may be transitioned from the first actuator position to the third actuator position by varying the operating parameter to the third value during the transition from the first actuator position towards the second actuator position. The third operating parameter value may be the same as the first operating parameter value.

The selective downhole actuator may comprise a protrusion/s and corresponding recess/es. The protrusion/s and recess/es may define the relative movement of the first and second portions of the selective downhole actuator. By way of example, the first portion of the selective downhole actuator may comprise the protrusion/s and the second portion may comprise the recess/es. One of either the protrusion/s or recess/es may define the paths between the actuator positions. For example, the recess/es may comprise a slot/s defining the path/s, with the protrusion/s extending into the slot/s. The protrusion/s and recess/es may comprise a slot and pin arrangement. For example, the selective downhole actuator may comprise a plurality of slots defining the paths, each slot being engaged by a corresponding guide pin. The plurality of slots and corresponding guide pins may comprise a pair of slots and corresponding guide pins.

Where the third actuator position corresponds to an open stroke position, the third actuator position may be a release position, such as where the protrusion exits the recess. For example, a pin may exit the path or guide slot (e.g. axially and/or rotationally), such as for releasing two portions previously connected or engaged via at least the selective downhole actuator. Accordingly the actuator may be utilised to release one portion of a tool or downhole string from another portion.

The selective downhole actuator may be mountable within a tool string so as to allow the passage of fluid therethrough. For example, the selective downhole actuator may be mountable to allow the passage of drilling and/or injection and/or formation fluid/s, such as production fluid/s. The string may comprise a drillstring. The string may comprise a work strings. The string may comprise coiled tubing.

The selective downhole actuator may be positioned or positionable at any point along the tool string.

The selective downhole actuator may comprise a passageway for the passage of fluid. The passageway may comprise a throughbore. The selective downhole actuator may comprise a sleeve or mandrel. The second portion of the selective downhole actuator may comprise the sleeve or mandrel. The sleeve or mandrel may be housed within a housing, such as a tubular portion of toolstring. The first portion of the selective downhole actuator may comprise the housing.

The selective downhole actuator may comprise a piston. The second portion of the selective downhole actuator may comprise the piston. The piston may be axially urged or moved according a pressure differential acting across the piston. The pressure differential acting across the piston may be generated by exposure to fluids at different pressures. For example, a first fluid pressure source, such as fluid within the throughbore, may be at a first pressure and another fluid pressure source, such as in an annulus (e.g. between the toolstring and casing or a borewall or the like), may be at a second pressure. Accordingly varying the pressure of at least one of the fluid pressure sources may vary the fluid pressure differential acting across the piston. For example, the first fluid pressure may be varied such that the resultant variation in fluid pressure differential with the second fluid pressure is sufficient to move the piston. Additionally or alternatively, the pressure differential acting across the piston may be variable by varying a flow rate, such as a flow rate through the selective downhole actuator. The variable flow rate may generate a correspondingly variable pressure differential within the selective downhole actuator, such as due to a flow restriction. The piston may be axially movable. For example selective variation in the pressure and/or flow rate may correspond to selectively moving or biasing the piston in an axial direction. The piston may comprise an axially-biased piston. For example, the selective downhole actuator may comprise a biasing member, such as a spring or resilient member, for biasing or assisting in biasing the piston in a particular direction. The biasing member may enhance and/or at least partially compensate a biasing force generated by a fluid pressure/s or fluid pressure differential.

At least a portion of a stroke of the actuator in at least one axial direction may be damped. For example, the window portion may be at least partially damped. The damping may comprise viscous damping. The piston may comprise a damped piston. The actuator may comprise a choke. For example, the piston may comprise at least a portion of a stroke that corresponds to a resultant flow of fluid in or adjacent the piston through and/or past a restriction. For example, the piston may comprise at least a portion with a cross-section that corresponds to a particular fit, such as a reduced or tight fit, with an adjacent wall, such that fluid that must flow between the piston and the adjacent wall during a stroke is restricted, prolonging the period required for the fluid to flow and thus prolonging the period for that corresponding portion of stroke of the piston. The choke may comprise an orifice. The piston or housing may define a change, such as a step change, in cross-section, the changed cross-section cooperating with an adjacent wall, such as a cylinder or chamber wall (e.g. of the housing or piston), to define a restricted flow path between the cylinder and the wall. The changed cross-section relative to another portion cross-section may comprise a reduced cross-section. For example, the housing may comprise a necking. Additionally, or alternatively, the changed cross-section relative to another portion cross-section may comprise an increased cross-section. For example, the sleeve or mandrel or piston may comprise a damping shoulder. Additionally or alternatively, the piston or an adjacent chamber may comprise a port or valve, the port or valve defining a restricted flow path for fluid into and/or out of the associated fluid chamber or passage such that a related movement of the piston relative to the chamber or passage is damped by the restricted flow of fluid through the port or valve.

The restricted flow path may be defined by a plurality of passages. The restricted flow path may be defined by a labyrinth or labyrinthine passage/s.

At least a portion of a stroke of the actuator in only a single axial direction. For example, the valve may comprise a directional valve, such as a one-way valve, which provides a damping choke or resistance in only one axial direction.

Alternatively, at least portions of strokes in two axial directions may be damped. The two axial directions may comprise opposite axial directions (e.g. left and right; or up and down, etc,—depending upon axial orientation of the tool string). For example, the piston may be damped for movement in both up and down axial directions.

The strokes in two axial directions may be similarly damped. For example, the choke or restriction may similarly damp travel in both axial directions (e.g. a fluid flow through and/or around a choke or restriction may be similar in both axial directions).

Alternatively, the strokes may be differently damped in each of the axial directions. For example, at least some damping may be directionally dependent and/or the damping may be defined differently in each axial direction. For example, a directional valve or restriction, such as a one-way valve, may provide increase damping in one axial direction compared to the other, opposite axial direction.

The damping may comprise hydraulic damping. The damping may comprise viscous damping provided by one or more of: choke/s, restriction/s, valve/s, passage/s, labyrinth/s, piston/s, or the like. The damping may be configurable or configured according to an intended or desired application or use. The damping may be configurable to provide a particular or predetermined window. The damping may be configurable by the selection of one or more of: a damping fluid/s, choke/s, restriction/s, valve/s, passage/s, labyrinth/s, piston/s or the like. For example, a fluid of a particular (static and/or dynamic) viscosity may be selected to provide a particular window portion, such as a window of a predetermined time period (e.g. a damping fluid with a lower viscosity may be selected to provide a window of 5 minutes, whilst a damping fluid with a higher viscosity may be selected to provide a window of 10 minutes, such as according to a desired application or use downhole).

Each of the first, second and third actuator positions may correspond to a respective operating parameter.

At least two of the respective operating parameters may be the same or at least similar. For example, the operating parameters corresponding to the first and third actuator positions may be the same or similar. The same or similar operating parameters may comprise a similar fluid condition. The similar fluid condition may comprise a similar fluid pressure and/or flow and/or fluid pressure differential. For example, the similar fluid condition may correspond to a pressurised fluid condition, such as when pumps are ON or fully-ON. Accordingly, the first and third actuator positions may correspond to pumps ON positions. The second actuator position may correspond to a different operating parameter, such as a different fluid condition from the first and/or third actuator positions. For example, the second actuator position may correspond to a reduced pressure fluid condition, such as when pumps are OFF.

Each of the first, second and third actuator positions may correspond to a respective actuator state.

At least two of the respective actuator states may be the same or at least similar. For example, the first and second actuator positions may correspond to a similar actuator state. For example, the first and second actuator positions may each correspond to an inactive actuator state. Accordingly, the selective downhole actuator may be subjected to cycles, such as endless cycles, of variations in the operating parameters without transitioning to an active position. For example, the selective downhole actuator may be subjected to cycles of periods of the pumps being ON and the pumps being OFF without being indexed to an active actuator state. Accordingly, downhole operations involving pumping may be performed without the possibility or risk of apparatus or operations associated with the selective downhole actuator being activated or inadvertently or undesirably activated.

At least two of the respective actuator states may be different. For example, the actuator state corresponding to the first and/or second actuator position/s may be different to the actuator state corresponding to the third actuator position. The selective downhole actuator may permit or enable the selection of a different actuator state for a same or similar operating condition. The selective downhole actuator may permit or enable the selection of the different actuator state for the same or similar operating condition when the selective downhole actuator is selectively indexed to the third actuator position by selectively varying the operating parameter during the transition. The selective downhole actuator may permit or enable the selection of the different actuator state for the same or similar operating condition only when the selective downhole actuator is selectively indexed to the third actuator position by selectively varying the operating parameter during the transition. The selective downhole actuator may permit or enable the selection of the different actuator state for the same or similar operating condition when indexed according to the predetermined pattern, sequence or procedure, such as to access the third actuator position.

The third actuator position may be indirectly accessible from the first actuator position via the primary path. For example, the selective downhole actuator may comprise a fourth actuator position, wherein the fourth actuator position is an intermediate actuator position between the first actuator position and the third actuator position.

The intermediate actuator position may define an additional pattern, sequence or procedure or a repetition of the first pattern, sequence or procedure, in order to access or index to the third actuator position. Providing or requiring such an additional or repetition of pattern, sequence or procedure may decrease the risk or likelihood of the third (or actuating) actuator position being inadvertently or undesirably accessed or indexed. For example, where the first predetermined pattern, sequence or procedure comprises turning pumps OFF or down to transition along the first primary path and turning the pumps back ON or up within the window in order to access the secondary or branch path, the secondary or branch path may lead to the intermediate actuator position rather than the third (or actuating) actuator position. Accordingly, in order to access the third actuator position, it may be required to further turn OFF or down pumps to transition along a second primary path and then turn pumps back ON or up in order to access a second or further branch or secondary path to access or index to the third (or actuating) actuator position.

The selective downhole actuator may be selectively reconfigurable to the intermediate actuator position by varying an operating parameter during a transition of the selective downhole actuator between the first and second actuator positions. The intermediate actuator position may be directly accessible from the primary path instead of the third actuator position being directly accessible from the primary path. The intermediate actuator position may be directly accessible from the primary path instead of the third actuator position being directly accessible from the primary path. The selective downhole actuator may be reconfigurable from the intermediate actuator position to the second actuator position. The selective downhole actuator may be reconfigurable from the intermediate actuator position to the second actuator position via a second primary path. The selective downhole actuator may be selectively reconfigurable to the third actuator position by varying an operating parameter during a transition of the selective downhole actuator between the first and second actuator positions.

The intermediate actuator position may correspond to the first operating parameter value.

The intermediate position may correspond to the same actuator state as the first actuator position. For example, the first and intermediate actuator state may correspond to the first actuator state, such as an inactive or non-actuating actuator state.

The selective downhole actuator may comprise a plurality of intermediate actuator position, each intermediate actuator position between the first (e.g. non-actuating) and the third (e.g. actuating) actuator positions.

Each of the first and intermediate position/s may correspond to the same operating parameter value.

The first and/or intermediate and/or second actuator position/s may each correspond to the same actuator state. For example, the first and/or intermediate and/or second actuator position/s may each correspond to the first actuator state.

Alternatively at least one intermediate position/s may correspond to a different actuator state. For example, the third actuator position may correspond to a first actuation actuator state, such as a long piston stroke position; and the at least one intermediate position/s may correspond to an intermediate actuating actuator state, such as an intermediate piston stroke position. Accordingly, it may be possible to hold or maintain the selective downhole actuator in an intermediate actuating actuator state, such as when the operating parameter is maintained at a first value. Such a selective downhole actuator may enable the extension or maintenance of a piston at two stroke lengths, such as to provide two active actuating positions or states. For example, such an actuator may enable operations at at least two different operating parameters (e.g. reaming or under-reaming at two or more different diameters).

Each intermediate actuator position may comprise further primary and secondary paths such that a next intermediate position or respectively the third intermediate position as appropriate is accessible only by varying the operating parameter during a transition of the selective downhole actuator between the respective actuator positions that provides the window for accessing the next (optional) actuator position (e.g. via the appropriate secondary or branch path).

For example, where there is one intermediate actuator position, the selective downhole actuator is transitionable to the third (active) actuator position by varying the operating parameters appropriately during the two sequential windows or transitions along the respective first and second primary paths. Similarly, where there may be two intermediate actuator positions between the first and third actuator positions, each intermediate position corresponding to the first operating parameter value, then the selective downhole actuator is transitionable to the third (active) actuator position by varying the operating parameters appropriately during the three sequential windows or transitions along the respective first and second primary paths and a third primary path.

Indexing the selective downhole actuator to the activating position may comprise or require at least two sequential variations of the operating parameter according to a predetermined pattern, sequence or procedure. At least two sequential variations may provide a failsafe or an additional reassurance that the likelihood or risk is reduced of undesired indexing towards an actuated actuator state (e.g. of the third actuator position). For example, in the event that the pumps temporarily fail or are inadvertently temporarily turned off, or there is an unrelated drop in fluid pressure (e.g. a valve or other restriction opening or closing), then the selective downhole actuator may not necessarily be indexed to an activating position as soon as the fluid pressure is restored, such as due to the re-engagement of the pumps or the reversal of the valve or other restriction.

The selective downhole actuator may comprise one or more support/s to support the selective downhole actuator at one or more of the actuator position/s. For example, the one or more support/s may be configured to carry at least a portion of a load or force otherwise transferable between the first and second portions of the selective downhole actuator at the one or more of the actuator position/s. The selective downhole actuator may comprise one or more support/s for supporting at actuator position/s corresponding to a particular operating parameter. For example, the selective downhole actuator may comprise one or more support/s for supporting when the selective downhole actuator is stroking, such as when the pumps are ON and/or when fluid pressure or resultant forces are higher or highest. The one or more support/s may be configured to reduce loads or forces carried by the protrusion/s and/or recess/es (e.g. the slot/s and guide pin/s). The one or more support/s may comprise one or more axial support/s. The one or more support/s may comprise one or more landing portion/s, such as landing shoulders, fingers, flanges or the like.

According to a further aspect there are provided at least some methods of downhole indexing. The methods may comprise indexing a downhole selective downhole actuator between at least a first actuator position, a second actuator position and a third actuator position. The methods may comprise selectively indexing to the third actuator position by varying an operating parameter during a transition of the selective downhole actuator between the first and second actuator positions.

According to a further aspect of at least some embodiments there is provided a downhole actuation apparatus. The downhole actuation apparatus may comprise at least a first position, a second position and a third position. The downhole actuator may be configurable and/or reconfigurable between the first position and the second position. The downhole actuator may be selectively configurable and/or reconfigurable to the third position by varying an operating parameter during a transition between the first and second positions.

The downhole apparatus may be configured to define a prolonged window during the transition between the first and second positions, the prolonged window providing for the selective variation of the operating parameter to select the third position. The downhole apparatus may be damped so as to provide the prolonged window. For example, the damping may provide a prolonged period of the window relative to an undamped apparatus.

The downhole actuation apparatus may comprise a downhole selective downhole actuator.

According to a further aspect there are provided at least some methods of downhole actuation. The methods may comprise reconfiguring a downhole apparatus between at least a first position, a second position and a third position. The methods may comprise selectively reconfiguring to the third position by varying an operating parameter during a transition between the first and second positions.

According to a further aspect of at least some embodiments there is provided a downhole tool comprising the downhole actuating apparatus or selective downhole actuator of any other aspect.

The tool may be selected from one or more of: a reamer; an under-reamer; a drill-tool; a valve; a scraping tool; a percussion tool; an agitator; a bypass tool; or the like.

The tool may be configured to be actuated and/or deactuated by the selective downhole actuator or downhole apparatus.

According to a further aspect of at least some embodiments there is provided a tool string comprising the downhole tool and/or actuating apparatus and/or selective downhole actuator of any other aspect.

The selective downhole actuator may be positioned or positionable at any point along the tool string. The selective downhole actuator may be located at any position in the tool string. The selective downhole actuator may be located in a BHA. The selective downhole actuator may be located near-bit. The selective downhole actuator may be located above a BHA. The selective downhole actuator may be located distal to the BHA.

The toolstring may comprise a plurality of downhole tools or selective downhole actuators or actuating apparatus. For example, the toolstring may comprise a plurality of selective downhole actuators. Each selective downhole actuator may be configured to actuate and/or deactuate an associated tool.

The associated tools may be different. For example a first tool associated with a first selective downhole actuator may comprise a valve. Accordingly the first selective downhole actuator may selectively actuate and/or deactuate the valve. A second tool associated with a second selective downhole actuator may comprise a piston, such as an axially movable or extendable piston (e.g. coupled to a laterally or radially extendable member, such as cutter block or the like). Accordingly the second selective downhole actuator may selectively actuate and/or deactuate the piston (e.g. to extend and/or retract the piston, such as to laterally or radially extend and/or retract the laterally or radially extendable member).

The first and second selective downhole actuators may be selectively indexable according to variation in the same operating parameters. Alternatively, the first and second selective downhole actuators may be selectively indexable according to variation in different operating parameters. For example, the first selective downhole actuator may be selectively indexed according to a variation in fluid pressure, such as internal or throughbore fluid pressure; whereas the second selective downhole actuator may be selectively indexed according to a variation in fluid flow rate.

The first selective downhole actuator may provide for a different window for accessing a third or optional actuator position from that of the second selective downhole actuator. Different windows may allow for the selective indexing of the respective selective downhole actuators according to a different predetermined pattern, sequence or procedure. The windows of the first and second selective downhole actuators may not overlap. Alternatively the windows may at least partially overlap. The windows of the first and second selective downhole actuators may be configured to allow selective indexing of the first and/or second selective downhole actuators to actuating actuator positions. The window of the/each selective downhole actuator may be configured by defining the portion of damped travel or transition. For example, a restriction may be moved or otherwise varied (e.g. in cross-section or size of restriction) so as to provide for a different start and/or end position of the damping in a stroke, such as a return stroke. The window of the first selective downhole actuator may provide a window for accessing a third or optional actuator position after the window of the second selective downhole actuator has passed or closed. Accordingly, an operator may await the closure or passing of the second selective downhole actuator window before varying the operating parameter for selectively indexing the first selective downhole actuator, such as to the optional or third actuator position.

Each of the plurality of selective downhole actuators may be located at any position in the toolstring.

The first and second selective downhole actuators may be located at similar positions in the toolstring, such as both in a BHA.

The first and second selective downhole actuators may be located proximal to each other. The first and second selective downhole actuators may be located adjacent to each other.

Alternatively the first and second selective downhole actuators may be located distal to each other.

The toolstring may comprise a passage for fluid, the passage communicating with a throughbore of the selective downhole actuator.

According to a further aspect there are provided at least some embodiments of a selective downhole actuator. The selective downhole actuator may comprise at least a first actuator position and a second actuator position. The selective downhole actuator may be reconfigurable between the first actuator position and the second actuator position.

At least a portion of at least a transition from the first actuator position to the second actuator position may be damped. Damping the at least a portion of the transition from the first actuator position to the second actuator position may provide for a prolonged or extended window.

The prolonged window may provide for additional or alternative functionality of the actuator. For example, the prolonged window may provide for an ability or an increased ability to access the third actuation position.

The prolonged window may effectively define an additional actuation position. For example, the prolonged window may provide a transitional actuation position between the first and second actuation positions and/or between the third and second actuation positions.

The prolonged window may effectively define an additional actuation position in the form of a transitional actuation position between an actuating position and a non-actuating position. The transitional actuation position may define an additional actuation state. The prolonged window may provide an alternative to holding an actuator at an intermediate or transitional axial position, such as holding by maintaining an intermediate fluid pressure or fluid flow to maintain an intermediate position.

The first actuator position may correspond to a stroke position. The first actuator position may correspond to an actuating position. The second actuation position may correspond to a no-stroke or return stroke position. The second actuation position may correspond to a non-actuating position.

According to a further aspect, there are provided at least some methods of downhole actuation. The methods may comprise providing an extended period between two actuation positions. The extended period may comprise an extended period of time and/or an extended period of travel. The method may comprise damping. The method may comprise providing a damped portion of travel.

At least a portion of a stroke of the actuator in only a single axial direction. For example, the valve may comprise a directional valve, such as a one-way valve, which provides a damping choke or resistance in only one axial direction.

Alternatively, at least portions of strokes in two axial directions may be damped. The two axial directions may comprise opposite axial directions (e.g. left and right; or up and down, etc,—depending upon axial orientation of the tool string). For example, the piston may be damped for movement in both up and down axial directions.

The strokes in two axial directions may be similarly damped. For example, the choke or restriction may similarly damp travel in both axial directions (e.g. a fluid flow through and/or around a choke or restriction may be similar in both axial directions).

Alternatively, the strokes may be differently damped in each of the axial directions. For example, at least some damping may be directionally dependent and/or the damping may be defined differently in each axial direction. For example, a directional valve or restriction, such as a one-way valve, may provide increase damping in one axial direction compared to the other, opposite axial direction.

The damping may comprise hydraulic damping. The damping may comprise viscous damping provided by one or more of: choke/s, restriction/s, valve/s, passage/s, labyrinth/s, piston/s, or the like. The damping may be configurable or configured according to an intended or desired application or use. The damping may be configurable to provide a particular or predetermined window. The damping may be configurable by the selection of one or more of: a damping fluid/s, choke/s, restriction/s, valve/s, passage/s, labyrinth/s, piston/s or the like. For example, a fluid of a particular (static and/or dynamic) viscosity may be selected to provide a particular window portion, such as a window of a predetermined time period (e.g. a damping fluid with a lower viscosity may be selected to provide a window of 5 minutes, whilst a damping fluid with a higher viscosity may be selected to provide a window of 10 minutes, such as according to a desired application or use downhole).

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e.g. the downhole apparatus or selective downhole actuator of one aspect may comprise features of any other aspect). Optional features as recited in respect of a method may be additionally applicable to an apparatus; and vice versa. For example, an apparatus may be configured to perform any of the steps or functions of a method.

In addition, corresponding means for performing one or more of the discussed functions are also within the present disclosure.

It will be appreciated that one or more embodiments/aspects may be useful in downhole indexing or actuation.

The above summary is intended to be merely exemplary and non-limiting.

As used herein, the term "comprise" is intended to include at least: "consist of"; "consist essentially of"; "include"; and "be". For example, it will be appreciated that where the actuator may "comprise an indexer", the actuator may "include an indexer" (and optionally other element/s); the actuator "may be an indexer"; or the actuator may "consist of an indexer"; etc. For brevity and clarity not all of the permutations of each recitation of "comprise" have been specifically stated. Similarly, as used herein with reference to a direction or orientation, it will be appreciated that "downhole" and "uphole" do not necessarily relate to vertical directions or arrangements, such as when applied in deviated, non-vertical or horizontal bores.

BRIEF DESCRIPTION OF THE DRAWINGS

Embodiments will now be described, by way of example, with reference to the accompanying drawings, in which:

FIG. 3 shows a cross-sectional schematic view of the selective downhole actuator in a neutral, starting, return or no-flow actuator position;

FIG. 4 shows a further cross-sectional schematic view of the selective downhole actuator of FIG. 2 with the actuator in a different actuator position;

FIG. 5 shows a yet further cross-sectional schematic view of the selective downhole actuator of FIG. 2 with the actuator in a further different actuator position;

FIG. 9 shows a detail view of the selective downhole actuator of FIG. 6 with the actuator in a first transitional actuator position in between the actuator positions of FIG. 4 and the neutral, starting, return or no-flow actuator position of FIG. 3;

FIG. 10 shows a detail view of the selective downhole actuator of FIG. 6 with the actuator in a second transitional actuator position in between the actuator positions of FIG. 4 and the neutral, starting, return or no-flow actuator position of FIG. 3;

FIG. 11 shows a detail view of the selective downhole actuator of FIG. 6 with the actuator returned to the neutral, starting, return or no-flow actuator position of FIG. 3 (and FIG. 7);

DETAILED DESCRIPTION OF THE DRAWINGS

Figure 1:
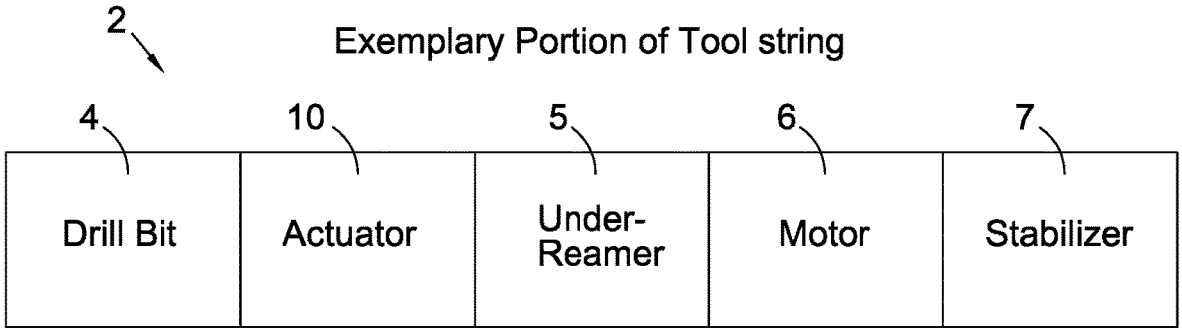
FIG. 1 shows a schematic representation of a toolstring comprising an embodiment of a selective downhole actuator.

Reference is first made to FIG. 1, which shows a schematic representation of a downhole tool string 2 in accordance with a first embodiment of the present invention. Here, the tool string comprises a selective downhole actuator 10 located near-bit in a BHA, adjacent an under-reamer 5, above a drill-bit 4. However, it will be appreciated that in other embodiments (not shown), the selective downhole actuator is located at any position in the tool string. It will also be appreciated that in other tool string embodiments (not shown) additional or alternative tools, including for selective downhole actuation, are selected from one or more of: a reamer; a drill-tool; a valve; a scraping tool; a percussion tool; an agitator; a bypass tool; or the like (not shown). Examples of under-reamers are described in applicant's International (PCT) Application Publication Nos. WO 2004/097163 and WO 2010/116152, the disclosures of which are incorporated herein by reference.

As shown here, the selective downhole actuator 10 is located downhole of a positive displacement motor 6 used to rotate the under-reamer 5, the actuator 10, and the drill-bit 4. In the embodiment shown a stabilizer 7 is also optionally provided as desired. It will be appreciated that in at least some embodiments, elements (not shown), such as a rotatable mandrel, may extend through the actuator 10, such as through a throughbore of the actuator 10.

The selective downhole actuator 10 can be used to selectively actuate and deactuate the under-reamer 5 such that the under-reamer 5 reams when desired and only when desired. The selective actuation will be described in detail below, with particular reference to embodiments of selective downhole actuators in the subsequent Figures.

Figure 2:
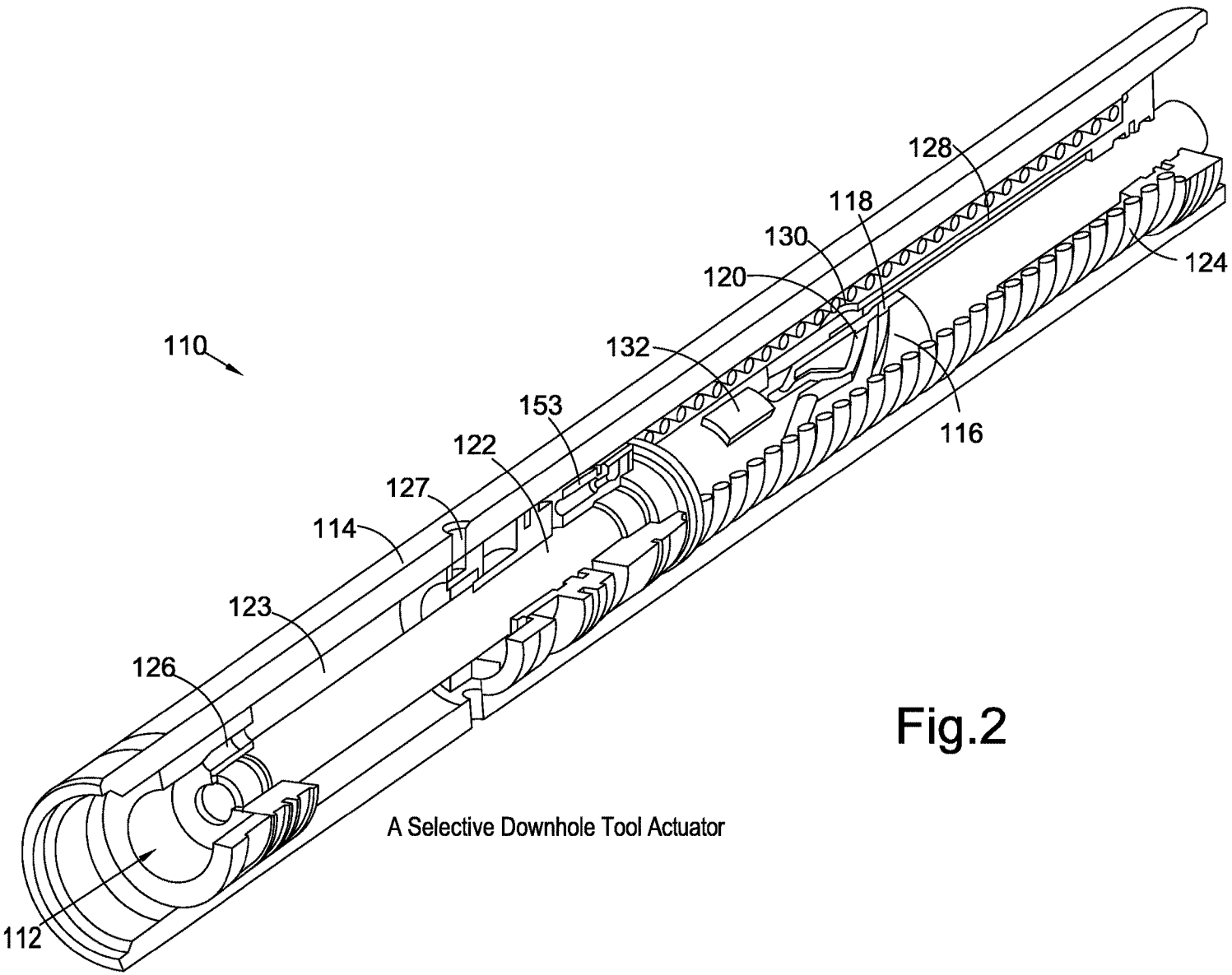
FIG. 2 shows a partial cutaway three-quarter isometric view of an embodiment of a selective downhole actuator.

Reference is now made to FIG. 2, which shows a partial cutaway three-quarter isometric view of an embodiment of a selective downhole actuator 110. It will be appreciated that the selective downhole actuator 110 shown may be mounted in a tool string, such as that shown in FIG. 1. For example, the selective downhole actuator 110 may be mounted using appropriate box connections at its upper and lower ends.

The selective downhole actuator 110 comprises at least a first actuator position, a second actuator position and a third actuator position. The selective downhole actuator is reconfigurable between the first actuator position and the second actuator position to the third actuator position by varying an operating parameter during a transition of the selective downhole actuator 110 between the first and second actuator positions, as will be described in detail below.

In the embodiment shown here, the selective downhole actuator 110 comprises a downhole indexer. Accordingly, the first, second and third actuator positions comprise a respective first, second and third indexing position; and the indexer is selectively indexable to the third indexing position by varying an operating parameter during a transition of the indexer between the first and second indexing positions.

The selective downhole actuator 110 is mountable within a tool string so as to allow the passage of fluid therethrough. For example, the selective downhole actuator 110 is mountable to allow the passage of drilling fluid or injection fluid or of formation fluids, such as production fluid. The selective downhole actuator 110 comprises a passageway 112 for the passage of fluid. Here, the passageway 112 comprises a central throughbore.

A first portion of the selective downhole actuator 110 comprises a housing 114 in the form of a tubular portion of toolstring here. A second portion of the selective downhole actuator 110 comprises a sleeve or mandrel 116 housed within the housing 114.

Here, the housing 114 comprises a pair of protrusions in the form of a pair of guide pins 118, each being positioned diametrically opposed from the other 118. The guide pins 118 are fixed to the housing 114 here via a support member 128. Here, the sleeve or mandrel 116 has a pair of recesses in the form of a pair of slot channels 120 also diametrically opposed from each other 120—with each of the corresponding pins 118 extending into the respective slot channel 120.

The selective downhole actuator 110 comprises a piston 122 integral with the sleeve or mandrel 116, the piston 122 being acted upon by fluid in an adjacent chamber 123. The chamber 123 is defined between the sleeve or mandrel 116 and the housing 114, external to the throughbore 112. Here, the chamber 123 is in fluid communication with the throughbore via an internal port 126. In addition an external port 127 to annulus is provided such that fluid in the chamber 123 is in fluid communication with the annulus. Accordingly, a fluid pressure differential across the internal port 126 may be generated with different pressure in the throughbore 112 and in the fluid chamber 123. The internal and external ports 126, 127 are sized and arranged such that the fluid pressure in the fluid chamber 123 corresponds to the external fluid pressure in the annulus. Whilst there is a fluid pressure differential across the internal port 126, an axial force acting on the piston 122 is generated.

It will be appreciated that in alternative embodiments, no internal port 126 may be provided, with the fluid chamber 123 only being in fluid communication with the external annulus. However, as shown here, the internal port 126 may provide a fluid supply that may assist in flushing the fluid chamber 123 such that the fluid chamber 123 may remain free of debris or obstructions.

The selective downhole actuator 110 comprises a biasing member, here in the form of a helical compression return spring 124. In FIG. 2, the spring 124 is shown for biasing the piston 122 to the left. The spring 124 acts against a force acting on the piston 122 that is generated by the fluid pressure differential acting across the port 126. Accordingly, the biasing or movement of the piston 122 is variable by adjusting the fluid pressure in the throughbore 112 to vary a fluid pressure differential across the port 126, such that the resultant fluid pressure force may be varied relative to the force applied by the spring 124. It will be appreciated, that in alternative embodiments, the spring biasing force may be at least augmented by a fluid pressure force generated by fluid pressure, such as from fluid entering the sealed chamber that houses the spring 124 via an external port.

The selective downhole actuator 110 comprises a support member 128 to support the selective downhole actuator 110 at a plurality of the actuator positions. Here, the support member 128 is configured to carry substantially all of a load or force otherwise transferable between the sleeve or mandrel 116 and the housing 114 of the selective downhole actuator 110 at at least the first and third actuator positions. The support member 128 supports the sleeve or mandrel 116 at actuator positions corresponding to when the selective downhole actuator 110 is stroking (e.g. with the sleeve or mandrel 116 moved to the right from FIG. 3, such as shown in FIGS. 4 and 5), when resultant forces of fluid pressure acting on the piston 122 (as a result of the fluid pressure differential from the throughbore 112 across the port 126) are higher than the biasing force of the spring 124, such as when the pumps are ON or fully ON.

With particular reference to FIGS. 3, 4 and 5 respectively, the selective actuator of FIG. 2 is shown in cross-sectional views in various positions, noting that the spring 124 has been omitted from FIG. 4 for clarity. The actuator 110 is shown in FIG. 4 in a first actuator position, which is a short stroke position in the embodiment shown. Here, the short stroke position of FIG. 4 is a non-actuating position, with the sleeve or mandrel 116 not extended sufficiently (to the right as shown) from an initial, neutral or return longitudinal position of FIG. 3 in order to cause actuation.

The sleeve or mandrel 116 is moved to the first actuation position of FIG. 4 from the position of FIG. 3 by increasing the fluid pressure differential across the port 126, such as by turning on pumps (not shown) pumping a fluid through the throughbore 112 (e.g. to power a downhole motor and/or to flush whilst drilling). Increasing the fluid pressure in the throughbore 112 causes an increased fluid pressure differential between fluid pressure in the throughbore 112 and the fluid pressure in the piston chamber 123. When the fluid pressure differential across the fluid port 126 is sufficient, the corresponding force generated on the piston 122 overcomes the biasing force of the spring 124 and the sleeve or mandrel 116 moves axially relative to the housing 114 (to the right as shown in FIGS. 2 to 5).

The movement of the sleeve or mandrel 116 relative to the housing 114 from the position of FIG. 3 to the position of FIG. 4 is guided by the pin 118 and slot 120 arrangement. In the position of FIG. 4, the sleeve or mandrel 116 is axially supported by the support member 128 in order to reduce axial loads or forces carried by the pins 118 that may be associated with the forces generated by the increased fluid pressure in the throughbore 112. The support member has a first landing portion 130 for supporting a corresponding support flange 132 of the sleeve or mandrel 116 at the short stroke position of FIG. 4, as can also be seen in FIGS. 8 and 12.

The actuator 110 can be returned from the first actuator position of FIG. 4 to the second actuator position of FIG. 3 by reducing the pressure differential across the piston 122, such as by turning down or off of pumps to reduce fluid pressure in the throughbore 112 and allowing the fluid pressure across the port 126 to balance or at least drop sufficiently below the biasing force of the spring 124.

FIG. 5 shows a third or different actuator position that may be selectively accessed subsequent to the first position of FIG. 4, as will be described in detail below with particular reference to FIGS. 6 to 36. In FIG. 5, the different actuator position shown is a long stroke position corresponding to an actuating position of the actuator 110, with the sleeve or mandrel 116 extending sufficiently (to the right as shown in FIG. 5) relative to the housing 114 to cause actuation, such as of an adjacent tool (not shown, e.g. to the right of the actuator 110 as shown in FIG. 5).

Figure 6:
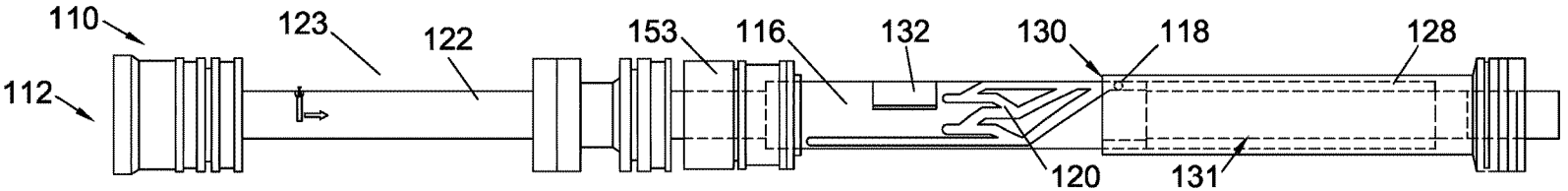
FIG. 6 shows a partial cutaway side view of the selective downhole actuator of FIG. 2 with the actuator in the actuator position of FIG. 3.

Referring now to FIGS. 6 to 17, there are shown an overview and then subsequent sequential views showing partial cutaway side views of the selective downhole actuator 110 of FIG. 2. FIG. 6 shows the overview of the actuator 110 with the housing 114 and the return spring 124 omitted for clarity. The actuator 110 is shown in FIG. 6 with the sleeve or mandrel 116 in the actuator position of FIG. 3. FIG. 6 shows the first landing shoulder 130 of the support member 128 for supporting the corresponding support flange 132 at the first actuator position of FIG. 4 and a second landing shoulder 131 of the support member 128 for supporting the corresponding support flange 132 at the actuator position of FIG. 5.

Figure 7:
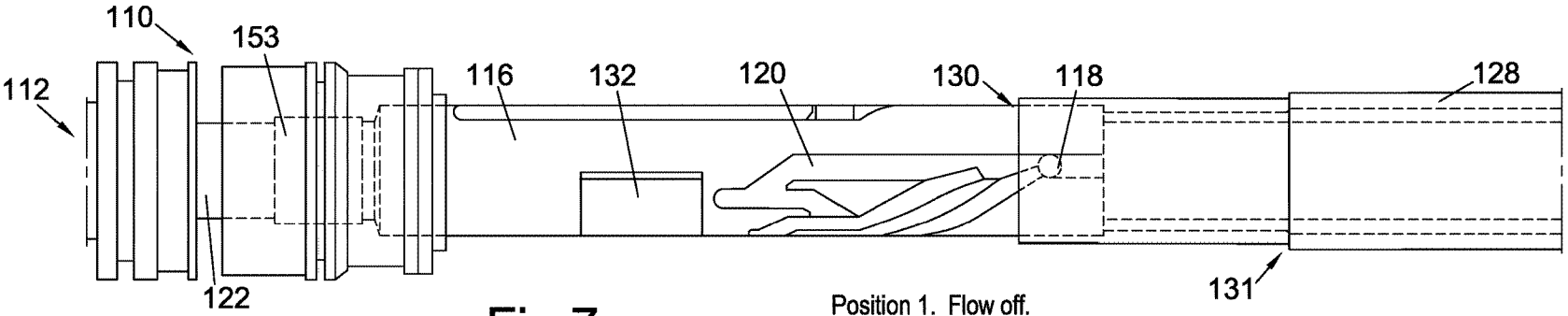
FIG. 7 shows a detail view of FIG. 6 with the actuator in the actuator position of FIG. 3.

FIG. 7 shows a detail view of FIG. 6, with the view position rotated 90° to provide a clearer side view of one of the guide pins 118. The actuator 110 is shown with the sleeve or mandrel 116 in the neutral or starting position such as may be associated with no flow through the throughbore 112 (e.g. prior to commencing a drilling operation or the like).

Figure 8:
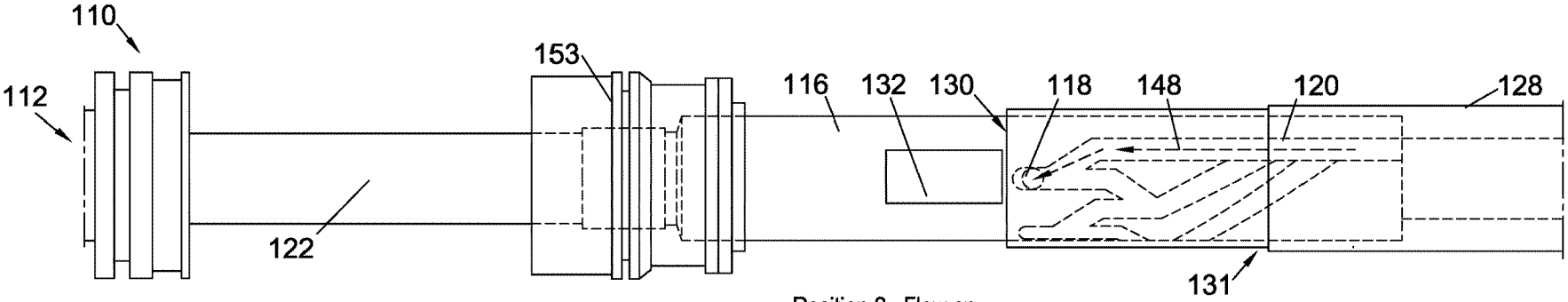
FIG. 8 shows a detail view of the selective downhole actuator of FIG. 6 with the actuator in the actuator position of FIG. 4.
Figure 37:
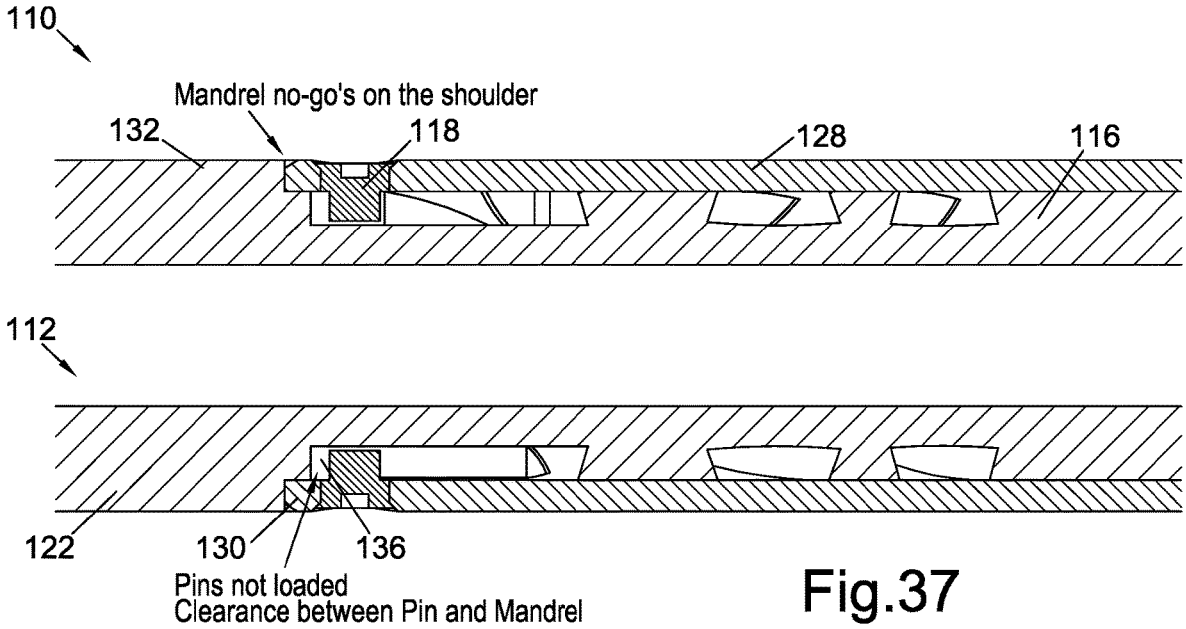
FIG. 37 shows a cross-sectional view of a portion of the selective downhole actuator of FIG. 6.

FIG. 8 shows a detail view with the sleeve or mandrel 116 moved or indexed to the first actuator position corresponding to FIG. 4 from the neutral or starting position of FIG. 3. It will be appreciated that the sleeve or mandrel 116 has moved relative to the housing 114 along a path 148 defined by the slot channel 120 engaging the projecting pin 118. The movement of the sleeve or mandrel 116 was propelled by the increase in fluid pressure differential across the port 126 generating an axial force (to the right as shown) on the piston 122 that overcame the biasing force (to the left as shown) of the spring 124. Just prior to the sleeve or mandrel 116 moving or extending sufficiently for the pin 118 to engage an axial end wall of a portion of the slot channel 120, the first landing shoulder 130 is engaged by the corresponding support flange 132 to define a no-go such that a clearance 136 (as shown in FIG. 37) is maintained between the pin 118 and the axial end wall of the slot channel 120.

FIG. 9 shows the actuator 110 in a first transitional actuator position in between the actuator positions of FIG. 8 and the neutral, starting, return or no-flow actuator position of FIG. 7. Again, it will be appreciated that the sleeve or mandrel 116 has moved relative to the housing 114 along the path 134 defined by the slot channel 120 engaging the projecting pin 118. From the position of FIG. 8 to the position of FIG. 9, the movement of the sleeve or mandrel 116 was propelled by the biasing force (to the left as shown) of the spring 124 acting on the sleeve or mandrel 116, which has become greater than an axial force (to the right as shown) generated on the piston 122 by a decrease in fluid pressure differential across the port 126, such as by turning down or off pumps. As shown in FIG. 9, the sleeve or mandrel 116 is moving relative to the housing 114 with the pin 114 at a first transitional position along a primary path 138 defining the transition from the first position of FIG. 8 to the second position of FIG. 11 (and FIG. 7—the second position also being the neutral or starting position in this instance).

A continuing imbalance between the force of the spring 124 and the pressure differential-generated force across the port 126 with the spring force being greater than the fluid pressure force as shown in FIG. 9, causes the sleeve or mandrel 116 to continue along the primary path 138 in the same axial direction. Accordingly, as shown in FIG. 10, the pin 118 reaches a second transitional position along the primary path 138 towards the second position of FIG. 11. Whilst the fluid pressure differential force remains lower than the spring force, the sleeve or mandrel 116 continues to move further in the same axial direction (to the left as shown in FIG. 10) such that the pin 118 is ultimately located in the second actuator position of FIG. 11, which in this embodiment shown is the same position as the neutral or starting position of FIG. 7.

Accordingly, the sequence of relative movements between the sleeve or mandrel 116 and the housing 114 of FIGS. 8 to 11 results in the actuator 110 being reconfigured between the first and second actuator positions. In the embodiment shown, the first actuator position of FIG. 8 is a short stroke position and the neutral or starting position of FIG. 7 is also the second or return actuator position of FIG. 11. All of the actuator positions of FIGS. 7 to 11 correspond to relatively limited axial movement of the sleeve or mandrel 116, such that all of the positions of FIGS. 7 to 11 correspond to non-actuating positions. Accordingly, the fluid operating conditions may be varied, such as by turning on and off pumps, without causing the actuator 110 to actuate. For example, the actuator may be incorporated in a drill string where it is desired to operate the pumps a number of times prior to extending the cutters of an underreamer, such as to test pumps, flush and/or drill without reaming. The fluid operating conditions may be endlessly varied without actuating the actuator 110, provided the operating conditions are not varied according to a predetermined pattern during the transition from the first position of FIG. 8 to the second position of FIG. 11, as will be described in detail below.

Figure 12:
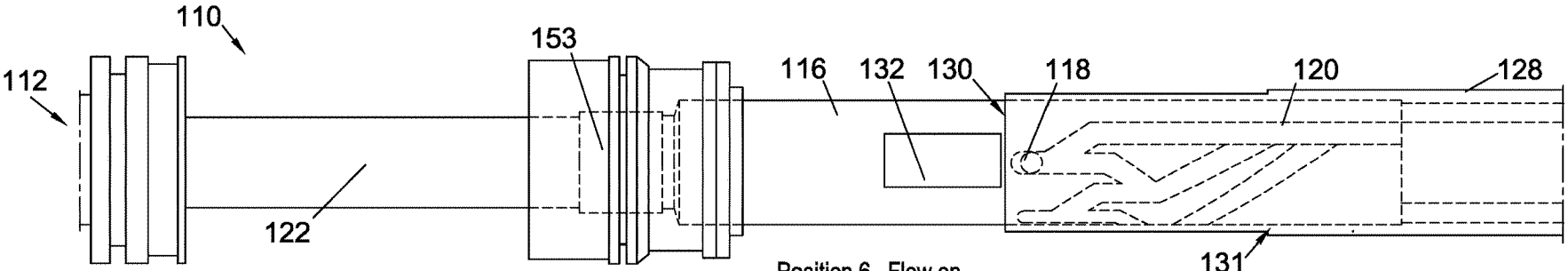
FIG. 12 shows a detail view of the selective downhole actuator similar to that of FIG. 6—with the actuator in the actuator position of FIG. 4.
Figure 13:
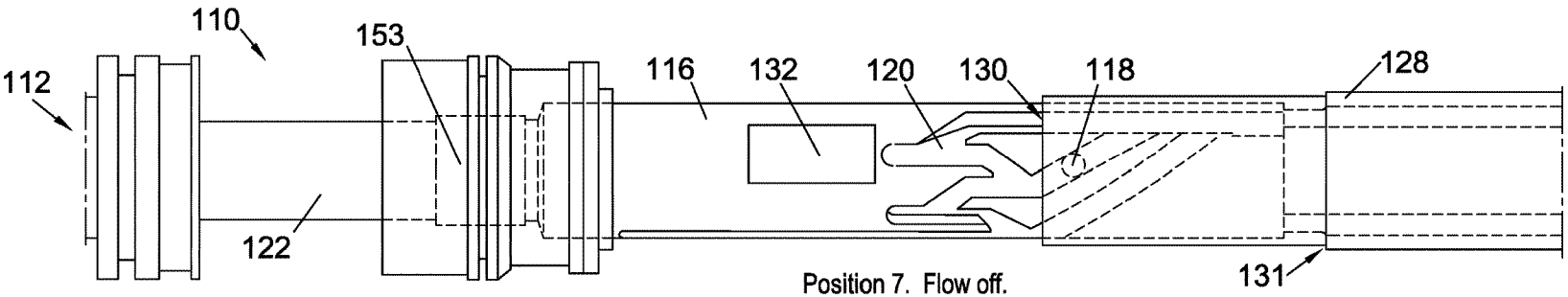
FIG. 13 shows a detail view of the selective downhole actuator of FIG. 6 with the actuator in an actuator position in between those of FIGS. 9 and 10.

FIG. 12 is the same as FIG. 8, with the sleeve or mandrel 116 moved or indexed to the first actuator position corresponding to FIG. 4 from the neutral or starting position of FIG. 3, with the pumps turned on, but with no actuation. FIG. 13 shows the actuator 110 with the sleeve or mandrel 116 moved, by turning the pumps off, to a transitional position between those of FIGS. 9 and 10. In FIG. 13, the pin 118 is located along a window portion of the primary path 138, the window portion of the primary path extending between a junction or intersection 140 and the second position of FIG. 11, the intersection 140 of the primary path defining an access route to an optional secondary path 142.

Figure 14:
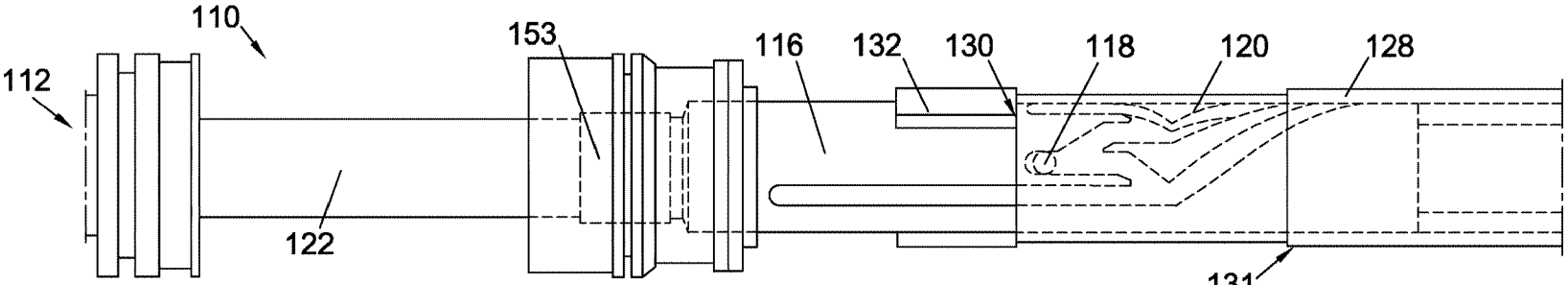
FIG. 14 shows a detail view of the selective downhole actuator of FIG. 6 with the actuator in a different actuator position.

The secondary path 142 provides access to a further actuator position of FIG. 14 and is accessible from the primary path 138 by the selective variation of an operating parameter during the relative transition of the pin 118 along the window portion of the primary path 138 from the first transitional actuator position of FIG. 9 towards the second transitional position of FIG. 10. Here, the further actuator position of FIG. 14 is a further short stroke position, which provides an intermediate actuator position prior to an actuating actuator position. The secondary path 142 may be considered as a branch path from the primary path 138, allowing for the selective transition from the first position to a further actuator position. Here, the secondary path 142 is accessed by turning the pumps back on whilst the pin 118 is relatively transitioning along the window portion of the primary path 138 towards the position of FIG. 11. Turning the pumps back on before the pin 118 reaches the position of FIG. 10 causes the axial direction of movement of the sleeve or mandrel 116 to reverse as the fluid pressure force (generated by the pressure differential across the port 126) overcomes the spring biasing force. Accordingly, the relative movement of the pin 118 along the primary path 138 is reversed and the pin 118 relatively travels towards the intersection 140, away from the second position of FIG. 10. On reaching the intersection 140, continued axial movement of the sleeve or mandrel 116 caused by the pumps being on causes the relative movement of the pin 118 in the slot 120 to continue along the secondary path 142. In the embodiment shown, the sleeve or mandrel 116 is not rotationally-biased relative to the housing 114, such that axial movement is in the direction of least resistance (e.g. direct axial movement where possible), such that the pin 118 does not continue back along the primary path 138 beyond the intersection 140 towards the position of FIG. 12, but instead follows the secondary path 142 beyond the intersection 140 towards the position of FIG. 14. In alternative embodiments, it will be appreciated that the sleeve or mandrel may be rotationally biased to at least assist in directing into a particular path or slot, such as a particular path that is not purely axial.

Again, just prior to the sleeve or mandrel 116 moving or extending sufficiently for the pin 118 to engage an axial end wall of a portion of the secondary path 142 of the slot channel 120, the first landing shoulder 130 is engaged by the corresponding support flange 132 to define a similar no-go such that a clearance 136 is maintained between the pin 118 and the axial end wall of the slot channel 120, as shown in FIG. 14.

The position of FIG. 14 is another short stroke position, such that again the actuator 110 is in a non-actuating position. Such a further short stroke position may allow for a turning back on of the pumps during a first return stroke (from the position of FIG. 8 to the position of FIG. 11), such as an accidental turning back on of the pumps. Or the further stroke position may allow for a brief lapse in fluid pressure, such as the pumps accidentally dropping or being turned off, or of a valve (elsewhere) in the string being opened or closed. In each case, the further stroke position of FIG. 14 may provide for a safety means to prevent or at least reduce a risk of accidental actuation of the actuator 110.

Figure 15:
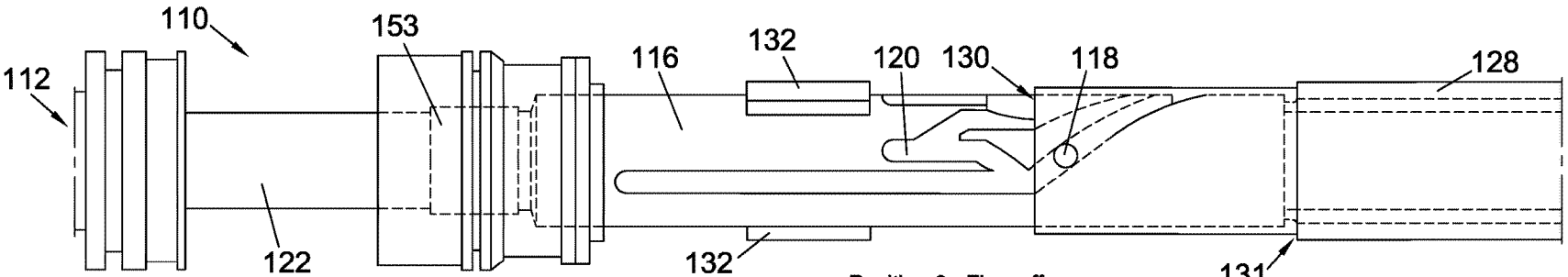
FIG. 15 shows a detail view of the selective downhole actuator of FIG. 6 with the actuator in a transitional position in between the positions of FIG. 14 and FIG. 7 (and FIGS. 3 and 11)
Figure 16:
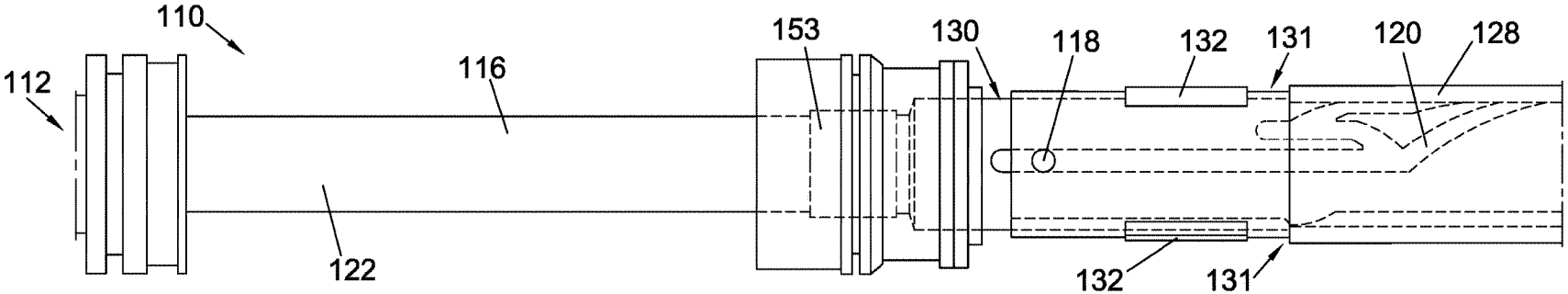
FIG. 16 shows a detail view of the selective downhole actuator of FIG. 6 with the actuator in a further different actuator position similar to that of FIG. 5.

FIG. 15 shows a position of the actuator 110 after the pumps have been turned off again, subsequent to the position of FIG. 14. The sleeve or mandrel 116 is forced axially by the spring 124 (to the left as shown) such that the pin 118 has transitioned along a return portion of the secondary path 142 towards the return neutral or starting position of FIGS. 7 and 11. The pin 118 is again located in another window portion of the return stroke in FIG. 15. Accordingly, if the pumps are switched on again for a second time before the pin 118 has relatively transitioned along the return portion of the secondary path to reach the return neutral or starting position of FIGS. 7 and 11, then the axial direction of movement of the mandrel or sleeve 116 relative to the housing 114 is reversed and the pin 118 travels relatively back along the return portion of the secondary path 142 towards a further junction or intersection 144, the further intersection 144 of the secondary path 144 defining an access route to an optional further secondary path 146. Again, the slot channel 120 is configured such that continued axial movement of the sleeve or mandrel 116 propelled by the fluid pressure force causes the pin 118 to relatively travel along the further secondary path 146 towards a further stroke position as shown in FIG. 16. The further stroke position of FIG. 16 is a long stroke position, corresponding to an actuating position. Accordingly, the actuator 110 is reconfigured or indexed to the actuating position by a predetermined series of changes in the fluid pressure, within windows provided in return portions of strokes. In this example, the actuator 110 is reconfigured or indexed to the actuating position only by re-engaging pumps during particular windows of two successive return strokes. Upon return to the neutral or starting position, the actuator must be reconfigured or indexed twice in particular succession in order to access the actuating position of FIG. 16. Accordingly, the actuator 110 may be incorporated in a drill string where it may be desirable to vary the fluid pressure without necessarily reconfiguring or indexing the actuator 110 to an actuating position, even although a particular fluid pressure may be reached during the variation that may otherwise be sufficient to actuate the actuator 110. Subsequent to actuation, the actuator 110 may be returned to the starting or neutral positions of FIGS. 7 and 11 by again turning off the pumps such that the sleeve or mandrel 116 and the housing 114 move axially, with the pin 118 relatively transitioning along the further secondary path 146 and return portion of the secondary path 142 from the position of FIG. 16 to the position of FIG. 17. Thereafter the actuator may be endlessly cycled between the short stroke position of FIG. 8, 12 or 14 and the neutral or start position of FIG. 7 or 11 without actuation; or endlessly cycled between these non-actuating positions and the actuating position of FIG. 16 by following the predetermined sequence of fluid pressure variations corresponding to FIGS. 11 to 16 sequentially.

Figure 17:
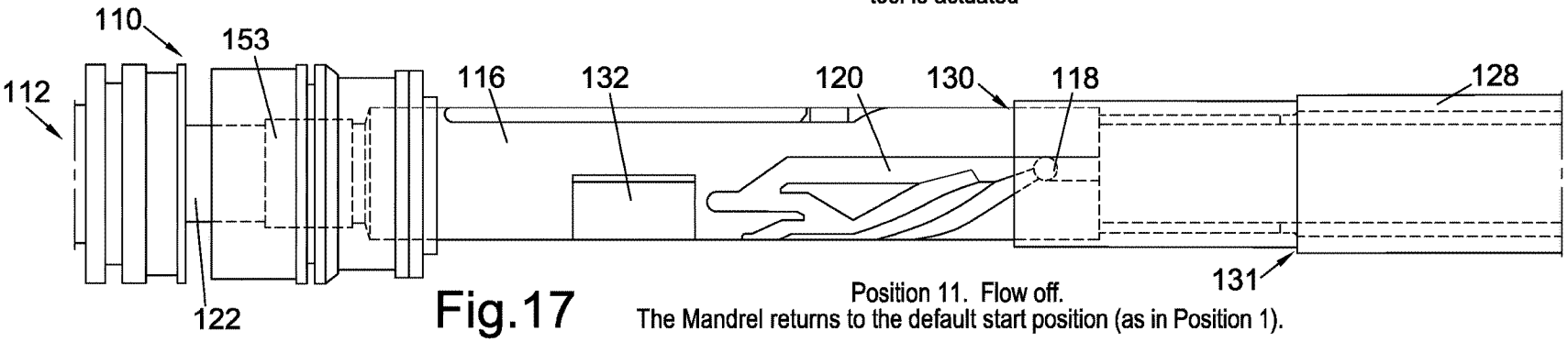
FIG. 17 shows a detail view of the selective downhole actuator of FIG. 6 with the actuator returned to the neutral, starting, return or no-flow actuator position of FIG. 3 (and FIGS. 7 and 11)

Once in the start or neutral position of FIG. 7, 11 or 17, the pin 118 always must transition along a main path 148 of the slot channel 120 to reach the first position of FIG. 8—and optionally any of the other actuating positions, such as of FIG. 14 and then 16. Accordingly, the main path 148 and the primary, secondary, and further secondary paths 138, 142 146 define circuits for the endless cycling of the actuator 110.

Figure 18:
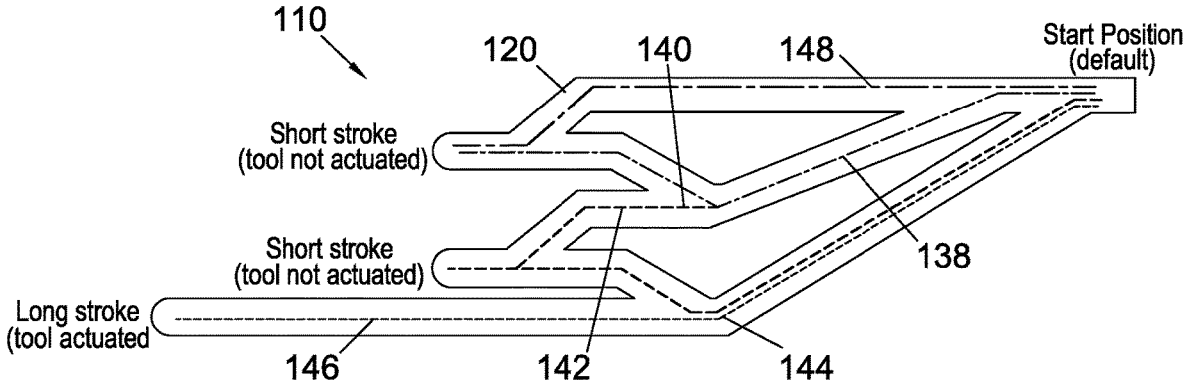
FIG. 18 shows a two-dimensional or flattened layout of a path of the selective downhole actuator of FIG. 3.

Referring now to FIG. 18, there is shown a two-dimensional or flattened representative layout of the slot channel 120 of the selective downhole actuator 110 of FIG. 3. The primary, secondary and further secondary paths 138, 142, 146 are shown, together with the appropriate intersections 140, 144 therebetween. It will be appreciated that in the embodiment shown here, the same slot channel 120 is repeated twice around the circumference of the sleeve or mandrel 116, although only one slot channel 120 is shown here for clarity.

Figure 19:
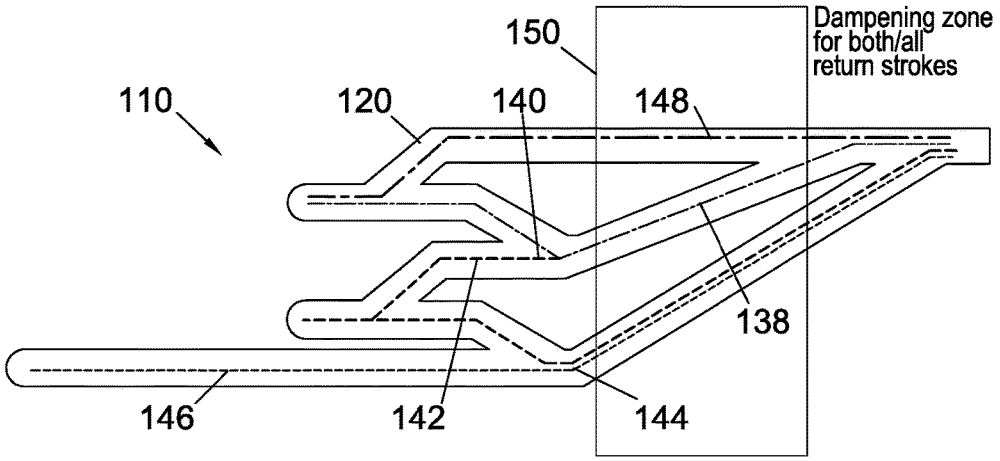
FIG. 19 shows the two-dimensional or flattened layout of the path of FIG. 18 indicating a damping zone or phase.
Figure 20:
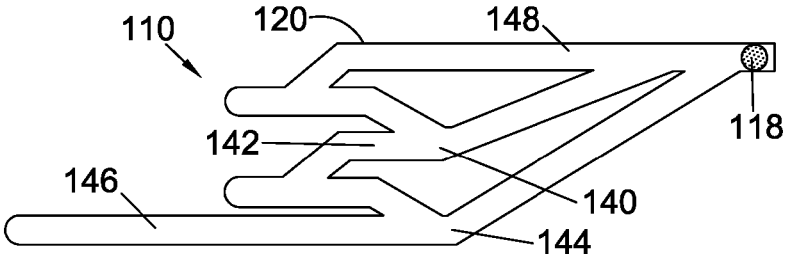
FIG. 20 shows the two-dimensional or flattened layout of the path of FIG. 18 with a cooperating element at a neutral, starting, return or no-flow position corresponding to the neutral, starting, return or no-flow actuator position of FIG. 3.

FIG. 19 indicates the window portion 150 of the axial return stroke of the sleeve or mandrel 116, as the sleeve or mandrel 116 travels axially towards the neutral or start positions of FIG. 7, 11 or 17, relative to the pin 118 (not shown in FIGS. 18 and 19). In the embodiment shown, the piston 122 is a damped piston during the window portion 150 of the axial return stroke of the sleeve or mandrel 116. A portion of the piston's 122 return stroke corresponds to a passage of a damping piston 153 associated and moveable with the piston 122 through a necking 152 of the housing to define a choke. During the passage of the damping piston 153 through the necking 152, the cross-sectional flow area for fluid, such as a fixed volume of oil, to flow between the chambers either axial side of the damping piston 153 is reduced, such that the rate of travel of the damping piston 153 and associated piston 122 is reduced. Accordingly, the period of transition from the stroking actuator positions of FIGS. 8 and 14 (and 16) to the start or neutral actuator position of FIGS. 7 and 11 (and 17) is extended or prolonged, at least relative to a conventional transition of a selective downhole actuator between actuator positions or of such an actuator without such damping provision. The damped portion corresponds to the window portion 150 for selectively accessing the optional (second and further second or third) actuating positions. Accordingly, a prolonged or extended period for selectively accessing the third actuator position is provided. The prolonged or extended period comprises sufficient time to distinguishably establish variation in the operating parameters. Here, the period provides for sufficient time and travel to sufficiently decrease fluid pressure to transition along at least a portion of the primary path 138 beyond the intersection 140, and then to sufficiently increase fluid pressure to reverse transition along the primary path 138 to access the secondary or branch path 142. For example, the window provides sufficient time for an operator at surface to receive feedback on a measured fluid pressure. Here, the window portion 150 provides for successive respective periods of between two and ten minutes for accessing each of the secondary and further secondary paths 142, 146. Damping at least a portion the transition between the actuator positions also reduce stresses or strains, such as may otherwise be associated with impact or higher velocity or undamped transitions or movements.

It will be appreciated that, in the embodiment shown, the choke, the pin 118 and slot 120 arrangement, the landing shoulders 130 and corresponding flanges 132, and the spring 124 are isolated from the fluid in the throughbore 112. In the embodiment shown, the choke, the pin 118 and slot 120 arrangement, the landing shoulders 130 and corresponding flanges 132, and the spring 124 are located in a chamber sealed from the throughbore 112, which, as shown, can be filled with a different fluid such as a closed oil reservoir, also isolated from the annulus external to the toolstring 110 in the embodiment shown.

It will also be appreciated, that the provision of a damped portion of transition that provides an extended period of time between actuation positions may be utilised in alternative or additional applications. For example, the damped portion may provide a sufficient period of time to define an intermediate actuation position. That intermediate actuation position may define an additional or intermediate actuation state or function. For example, that intermediate position may correspond to a further actuation state, such as to define an additional state or function of a tool or member actuatable by the actuator. For example, the damped portion may correspond to an intermediate state of a valve, which may be held in an intermediate state (e.g. partially open) between two other states (e.g. fully closed and fully open), at least for the duration of the damped period of transition. Other applications may include the use of the damped portion to provide an intermediate position of a tool, member or element associated with the actuator, such as an intermediate extension position of a member (e.g. a cutter).

Figure 21:
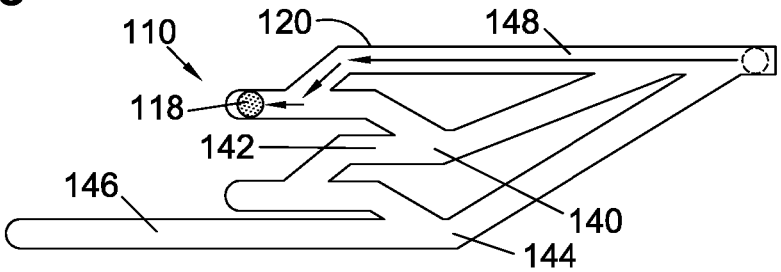
FIG. 21 shows the two-dimensional or flattened layout of the path of FIG. 18 with the cooperating element at an actuator position corresponding to that of FIG. 4 (and FIG. 8)
Figure 22:
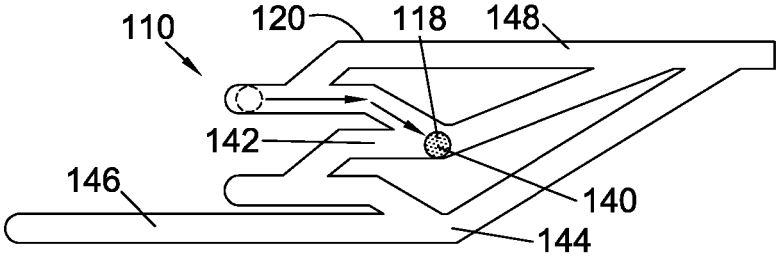
FIG. 22 shows the two-dimensional or flattened layout of the path of FIG. 18 with the cooperating element at an actuator position corresponding to that of FIG. 9.
Figure 23:
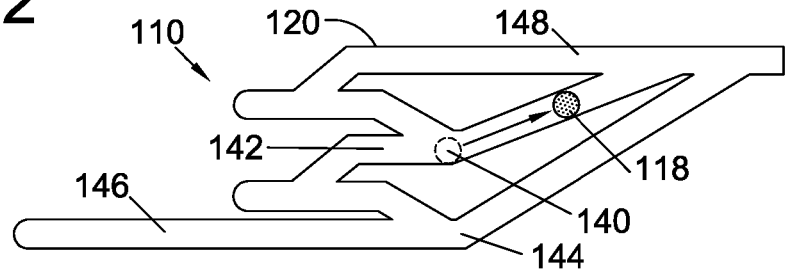
FIG. 23 shows the two-dimensional or flattened layout of the path of FIG. 18 with the cooperating element at an actuator position corresponding to that of FIG. 10.
Figure 24:
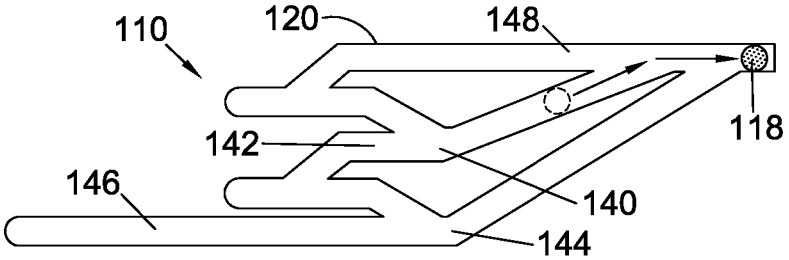
FIG. 24 shows the two-dimensional or flattened layout of the path of FIG. 18 with the cooperating element at an actuator position corresponding to that of FIG. 20.
Figure 25:
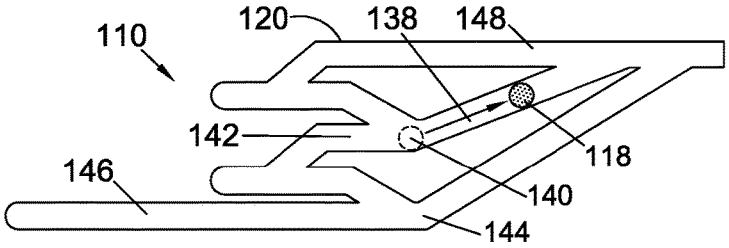
FIG. 25 shows the two-dimensional or flattened layout of the path of FIG. 18 with the cooperating element at an actuator position corresponding to that of FIG. 23.
Figure 26:
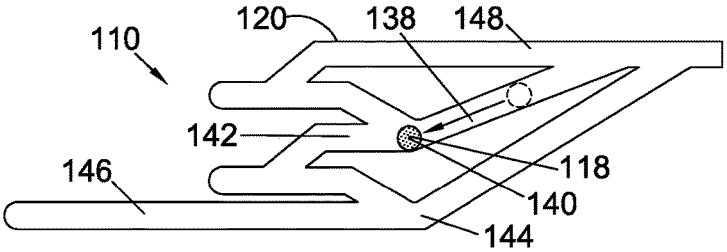
FIG. 26 shows the two-dimensional or flattened layout of the path of FIG. 18 with the cooperating element at an actuator position corresponding to that of FIG. 22.
Figure 27:
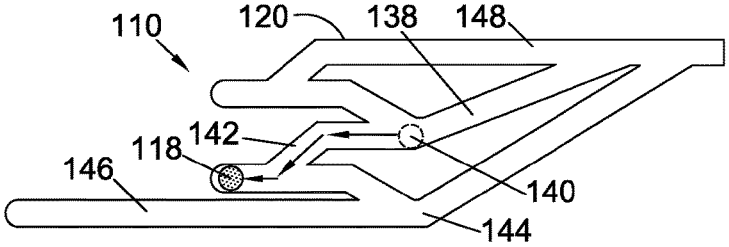
FIG. 27 shows the two-dimensional or flattened layout of the path of FIG. 18 with the cooperating element at an actuator position corresponding to that of FIG. 14.
Figure 28:
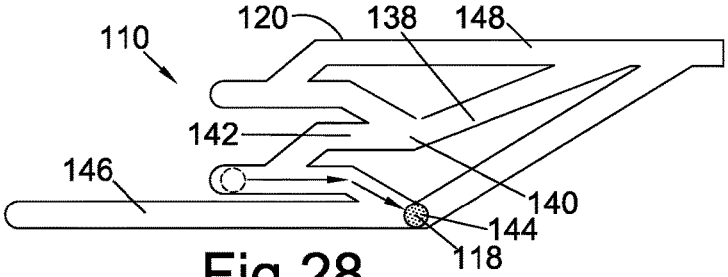
FIG. 28 shows the two-dimensional or flattened layout of the path of FIG. 18 with the cooperating element at a transitional actuator position in between the positions of FIG. 27 and FIG. 20 (and FIG. 24)
Figure 29:
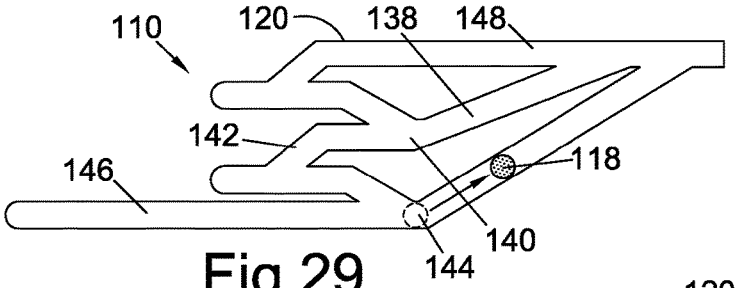
FIG. 29 shows the two-dimensional or flattened layout of the path of FIG. 18 with the cooperating element at a further transitional actuator position—generally similar to the position of FIG. 15—in between the positions of FIG. 27 and FIG. 20 (and FIG. 24)
Figure 30:
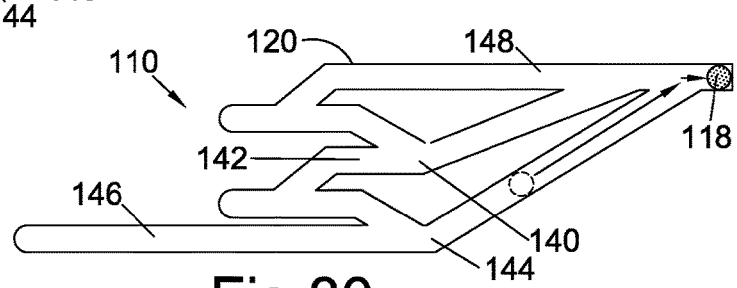
FIG. 30 shows the two-dimensional or flattened layout of the path of FIG. 18 with a cooperating element at a neutral, starting, return or no-flow position corresponding to the neutral, starting, return or no-flow actuator position of FIG. 20.
Figure 31:
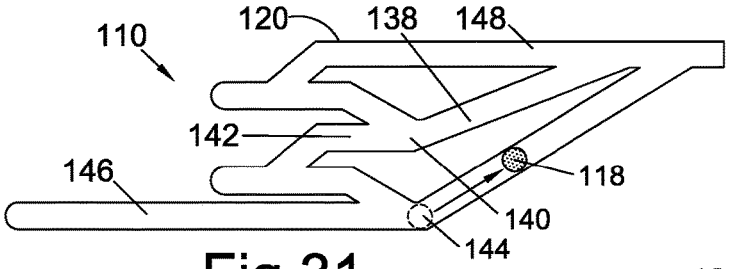
FIG. 31 shows the two-dimensional or flattened layout of the path of FIG. 18 with the cooperating element at an actuator position corresponding to that of FIG. 29.
Figure 32:
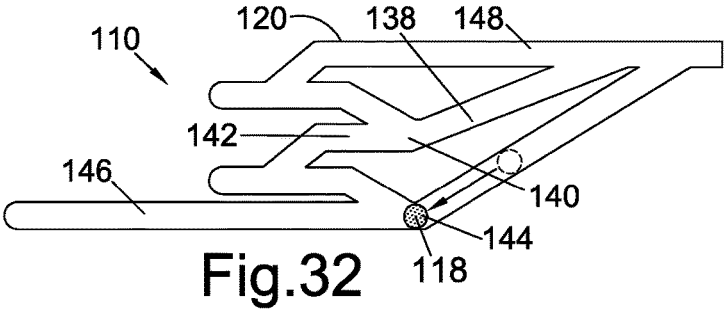
FIG. 32 shows the two-dimensional or flattened layout of the path of FIG. 18 with the cooperating element at an actuator position corresponding to that of FIG. 28.
Figure 33:
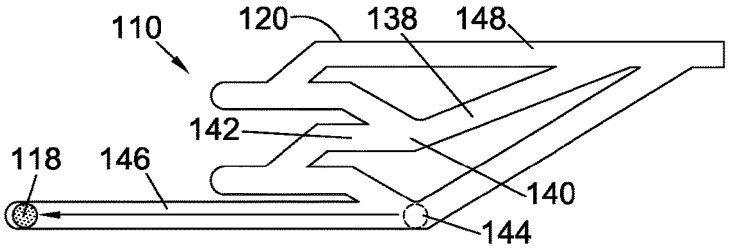
FIG. 33 shows the two-dimensional or flattened layout of the path of FIG. 18 with the cooperating element in a further different actuator position corresponding to that of FIGS. 5 and 16.
Figure 34:
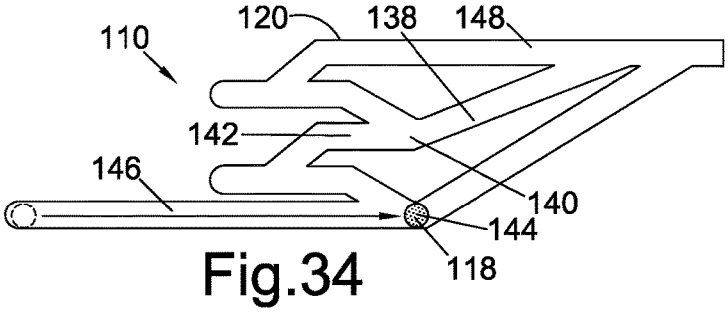
FIG. 34 shows the two-dimensional or flattened layout of the path of FIG. 18 with the cooperating element at an actuator position corresponding to that of FIG. 32.
Figure 35:
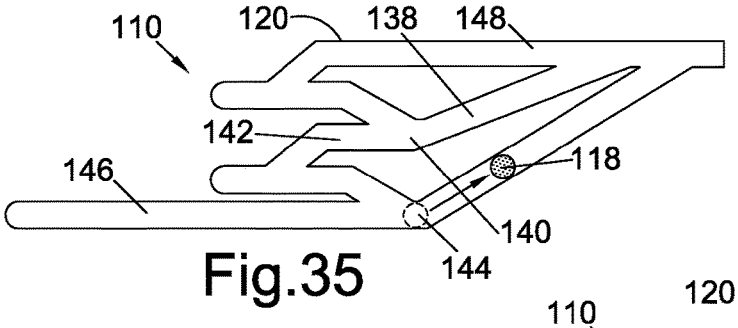
FIG. 35 shows the two-dimensional or flattened layout of the path of FIG. 18 with the cooperating element at an actuator position corresponding to that of FIG. 31.
Figure 36:
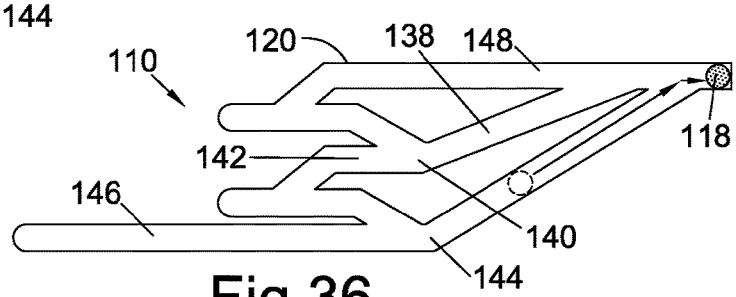
FIG. 36 shows the two-dimensional or flattened layout of the path of FIG. 18 with a cooperating element at a neutral, starting, return or no-flow position corresponding to the neutral, starting, return or no-flow actuator position of FIG. 30.

FIGS. 20 to 36 show sequentially the successive relative positions and movements therebetween of the pin 118 relative to the slot channel 120, with a previous position of the pin 118 being indicated in broken lines and preceding movement identified with appropriate arrows along the slot channel 120. FIGS. 20, 24, 30 and 36 show the relative position of the pin 118 to the slot channel 120 corresponding to the neutral or start position of FIGS. 3, 7, 11 and 17. FIG. 21 shows the relative position of the pin 118 to the slot channel 120 corresponding to the short stroke position of FIGS. 4, 8, and 12. FIG. 27 shows the relative position of the pin 118 to the slot channel 120 corresponding to the intermediate short stroke position of FIG. 14. FIG. 33 shows the position of the pin 118 relative to the slot channel 120 corresponding to the long stroke position of FIGS. 5 and 16. FIGS. 22, 23, 25, 26, 28, 29, 31, 32, 34 and 35 show the positions of the pin 118 relative to the slot channel 120 in between the immediately preceding and succeeding numbered figure. For example, FIG. 22 shows the position of the pin 118 relative to the slot channel 120 in between the positions of FIG. 21 and FIG. 23. Accordingly it is clear that the actuator may be selectively actuated by performing a predetermined operating sequence to vary fluid parameters to control actuation of the actuator 110, whilst providing the possibility to vary fluid parameters without affecting the actuation state of the actuator, such as to prevent unintended or accidental actuation.

It will be appreciated that the selective downhole actuator 110 is configured to transition by default to a particular actuation state in a particular condition, such as whenever subjected to a particular operating parameter condition. In the embodiment shown here, the default actuation state corresponds to a single default actuation position of FIGS. 20, 24, 30 and 36, which can be considered as a default axial and rotational actuation position. Here, where the actuator 110 is defaulting to a non-actuating state under no flow or low fluid pressure from the first, third and intermediate actuation positions, the actuator defaults to the second actuation position, which is also the initial or starting position as shown here.

FIG. 37 shows a detail view of the actuator 110 of FIG. 4, with the first landing shoulder 130 engaging the corresponding flange 132 at the short stroke position, corresponding to that of FIGS. 8 and 14. Accordingly, the clearance 136 between the pin 118 and an axial end wall of the slot 120 is clearly visible.

Figure 38:
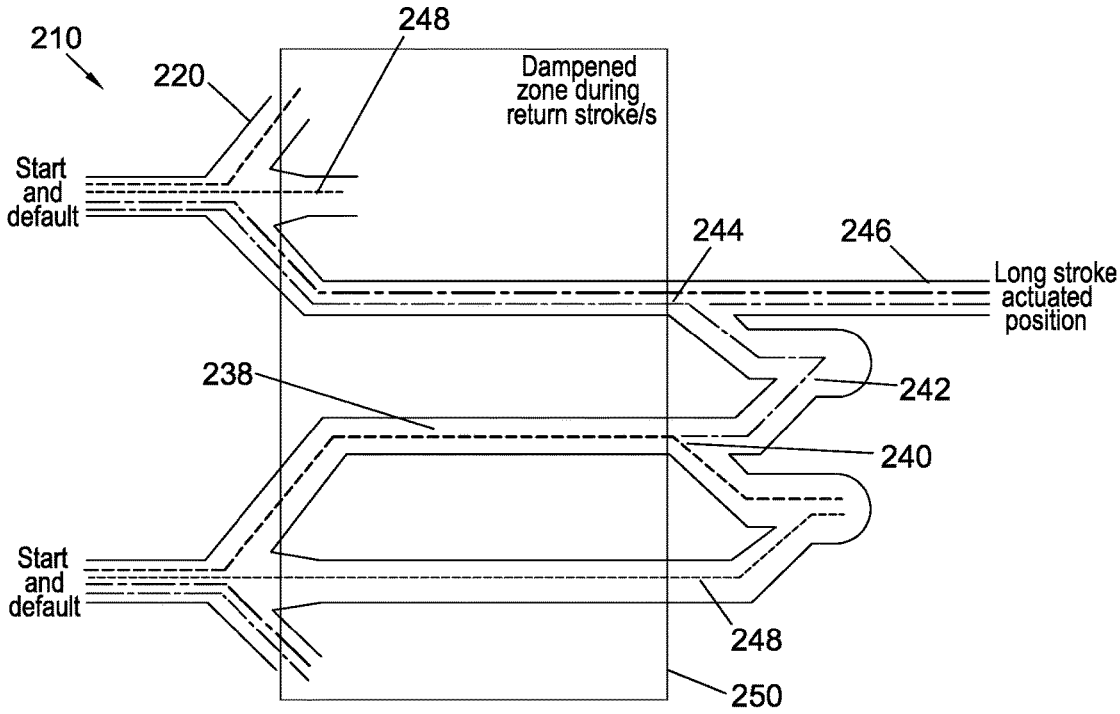
FIG. 38 shows a two-dimensional or flattened layout of a path of a selective downhole actuator, indicating a damping zone or phase.

FIG. 38 shows an alternative slot channel 220 for providing a similar actuation pattern to that of the slot channel 120 of FIG. 18, with similar features denoted by similar reference numerals, incremented by 100. Accordingly, the slot channel comprises a primary path 238 and a first intersection 240. As shown here, the direction of fluid pressure force and also of spring bias are reversed (i.e. the fluid pressure force acts to propel the sleeve or mandrel 216 to the left, whilst the spring—not shown here—acts to propel the mandrel or sleeve to the right). Such an arrangement may be achieved by substantially inverting the actuator 110 of FIG. 6 or by swapping the positions of the spring 124 and the piston chamber 123 of FIG. 6. Accordingly, it will be appreciated that the neutral or starting position shown in FIG. 38 corresponds to a similar neutral or starting actuator axial or longitudinal position of FIGS. 3, 7, 11, 17, 20, 24, 30 and 36.

Figure 45:
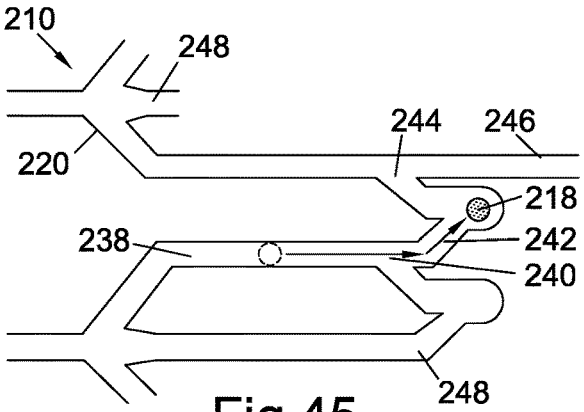
FIG. 45 shows the two-dimensional or flattened layout of the path of FIG. 38 with the cooperating element at an actuator position similar to that of FIG. 14 (and FIG. 27)
Figure 46:
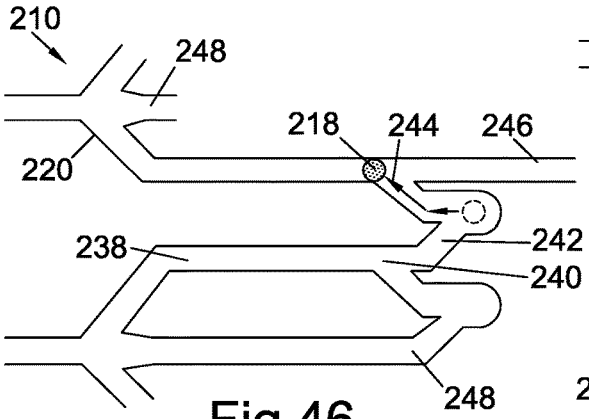
FIG. 46 shows the two-dimensional or flattened layout of the path of FIG. 38 with the actuator in a first transitional actuator position in between the actuator positions of FIG. 45 and a neutral, starting, return or no-flow actuator position similar to FIG. 39.
Figure 47:
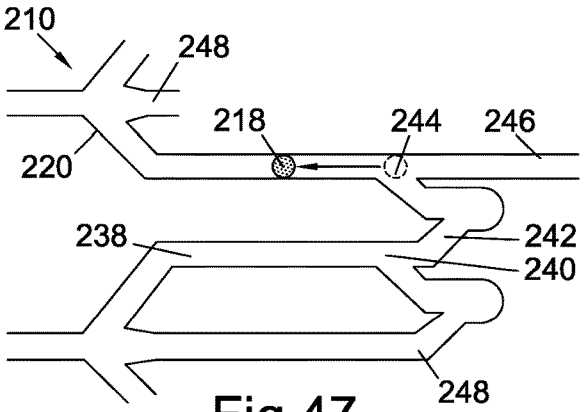
FIG. 47 shows the two-dimensional or flattened layout of the path of FIG. 38 with the actuator in a second transitional actuator position—in between the first transitional position of FIG. 46 and a neutral, starting, return or no-flow actuator position similar to FIG. 39.
Figure 50:
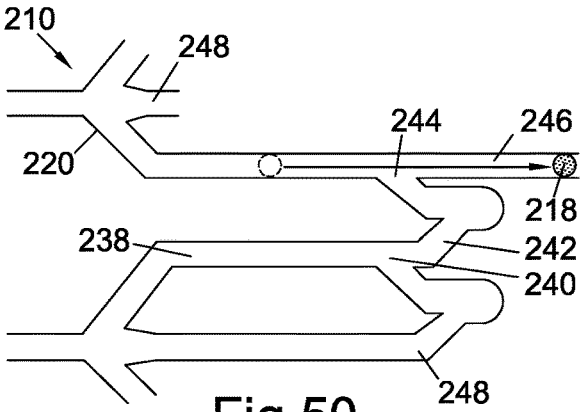
FIG. 50 shows the two-dimensional or flattened layout of the path of FIG. 38 with the cooperating element in a further different actuator position similar to that of FIGS. 5, 16 and 33.
Figure 51:
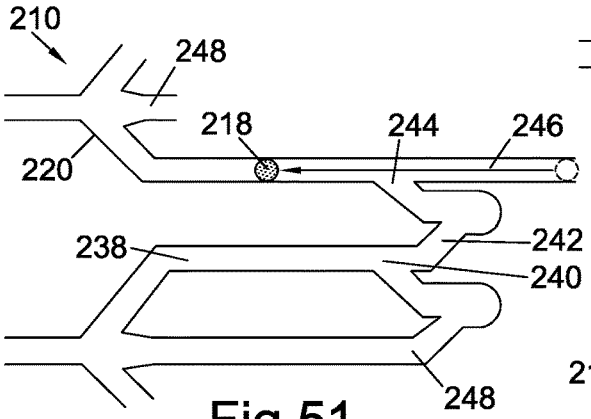
FIG. 51 shows the two-dimensional or flattened layout of the path of FIG. 38 with the cooperating element at an actuator position corresponding to that of FIG. 49.
Figure 52:
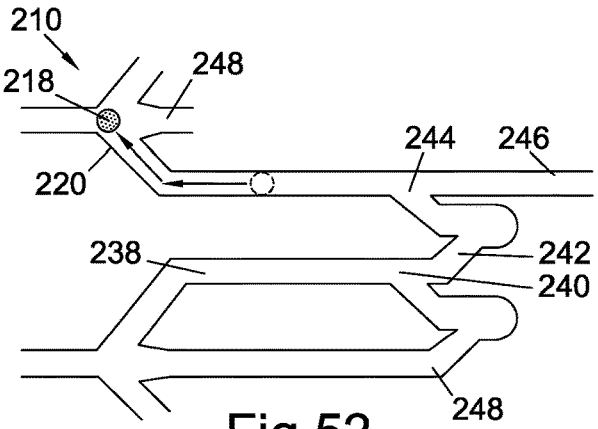
FIG. 52 shows the two-dimensional or flattened layout of the path of FIG. 38 with the cooperating element in a third transitional actuator position—in between the second transitional position of FIG. 47 and a neutral, starting, return or no-flow actuator position similar to FIG. 39.

FIGS. 39 to 53 show sequentially the successive relative positions and movements therebetween of the pin 218 relative to the slot channel 220, with a previous position of the pin 218 being indicated in broken lines and preceding movement identified with appropriate arrows along the slot channel 220. Again, in the embodiment here, there is provide a first short stroke position, shown in FIG. 40; and a further short stroke position, in FIG. 45 intermediate the stroking position of FIG. 40 and a long stroke position of FIG. 50. The first short stroke position of FIG. 40 is generally functionally similar to that of FIGS. 4, 8, 12 and 21. The intermediate short stroke position of FIG. 45 is generally functionally similar to that of FIGS. 14 and 27. The long stroke position of FIG. 50 generally corresponds functionally to the long stroke position of FIGS. 5, 16 and 33. However, in the embodiment of FIGS. 38 to 53, subsequent to actuation by accessing the long stroke position of FIG. 50 or of accessing the intermediate short stroke position of FIG. 46, the pin 218 does not necessarily return to the same return actuator position upon completion of the return stroke as in the embodiment of FIGS. 2 to 37. Rather, the return portion of the secondary path 242 (and, here, the further secondary path 246) does not necessarily require returning to the same return position as the starting or neutral position of FIG. 39.

Figure 39:
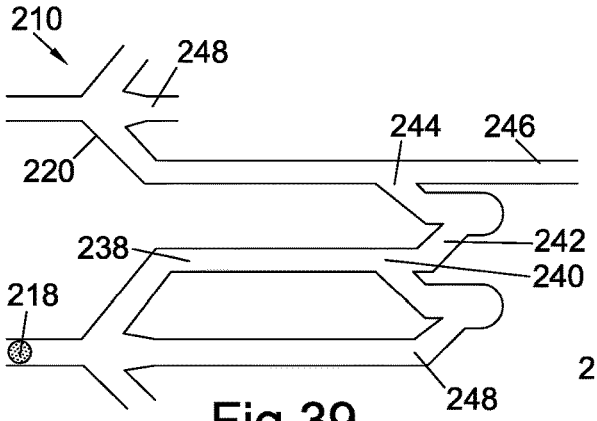
FIG. 39 shows the two-dimensional or flattened layout of the path of FIG. 38 with a cooperating element at a neutral, starting, return or no-flow position corresponding to the neutral, starting, return or no-flow actuator position of FIG. 3.
Figure 40:
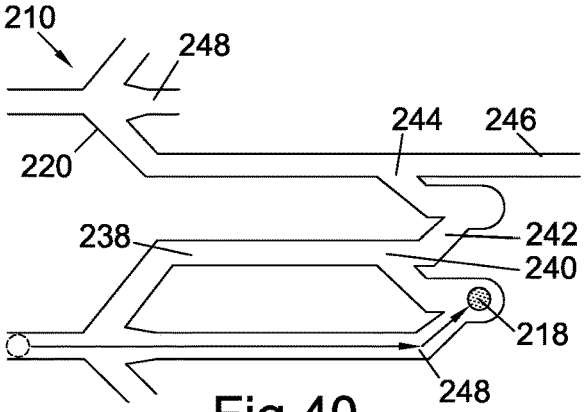
FIG. 40 shows the two-dimensional or flattened layout of the path of FIG. 38 with the cooperating element at an actuator position similar to that of FIG. 4 (and FIG. 8)
Figure 41:
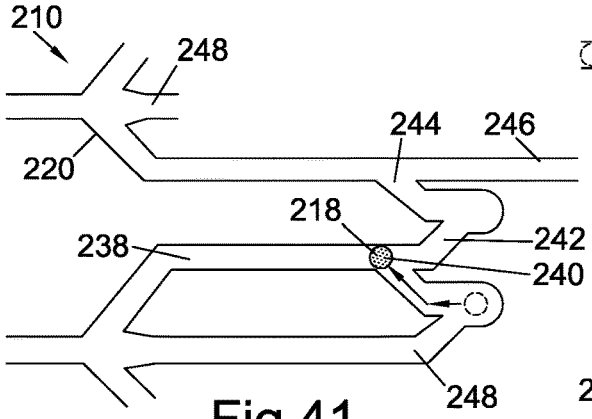
FIG. 41 shows the two-dimensional or flattened layout of the path of FIG. 38 with the cooperating element at an actuator position similar to that of FIG. 9 (and FIG. 22), with the actuator in a transitional actuator position in between the actuator positions of FIG. 40 and the neutral, starting, return or no-flow actuator position of FIG. 39.
Figure 42:
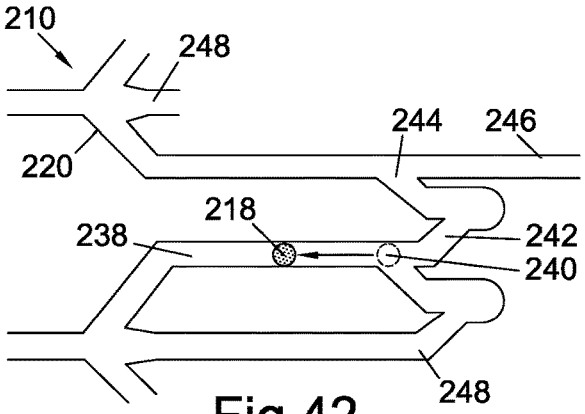
FIG. 42 shows the two-dimensional or flattened layout of the path of FIG. 38 with the cooperating element at an actuator position similar to that of FIG. 10 (and FIG. 23)
Figure 43:
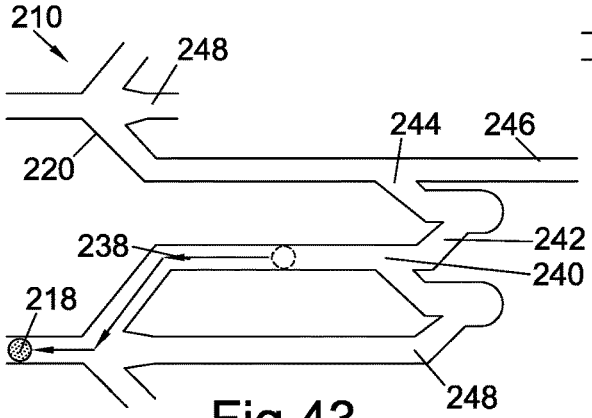
FIG. 43 shows the two-dimensional or flattened layout of the path of FIG. 38 with a cooperating element at a neutral, starting, return or no-flow position corresponding to the neutral, starting, return or no-flow actuator position of FIG. 39.
Figure 44:
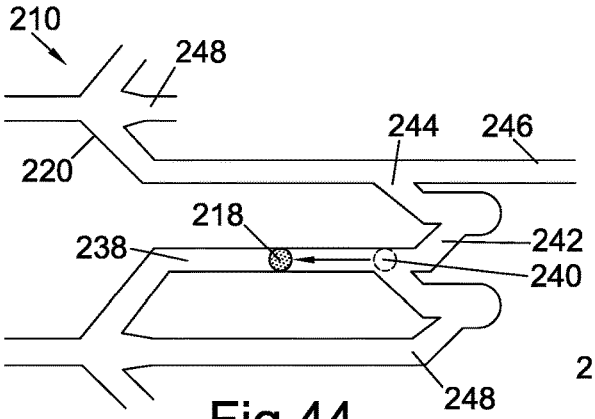
FIG. 44 shows the two-dimensional or flattened layout of the path of FIG. 38 with the cooperating element at an actuator position corresponding to that of FIG. 42 (and similar to that of FIG. 23)
Figure 48:
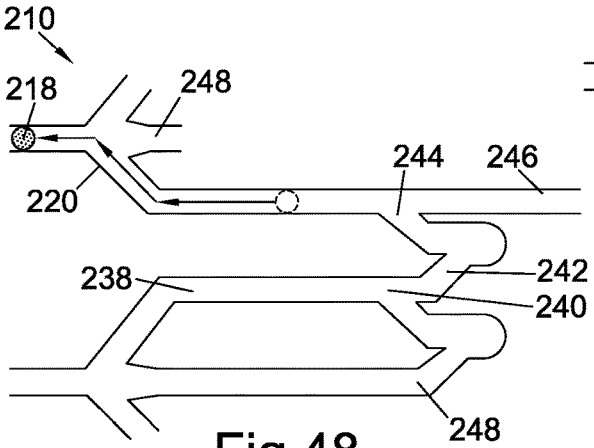
FIG. 48 shows the two-dimensional or flattened layout of the path of FIG. 38 with the actuator in a neutral, starting, return or no-flow actuator position similar to that of FIG. 39.
Figure 49:
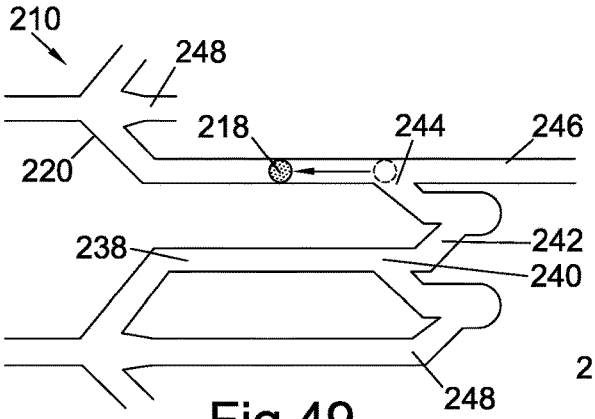
FIG. 49 shows the two-dimensional or flattened layout of the path of FIG. 38 with the actuator in the second transitional actuator position of FIG. 47—in between the first transitional position of FIG. 46 and a neutral, starting, return or no-flow actuator position similar to FIG. 39.
Figure 53:
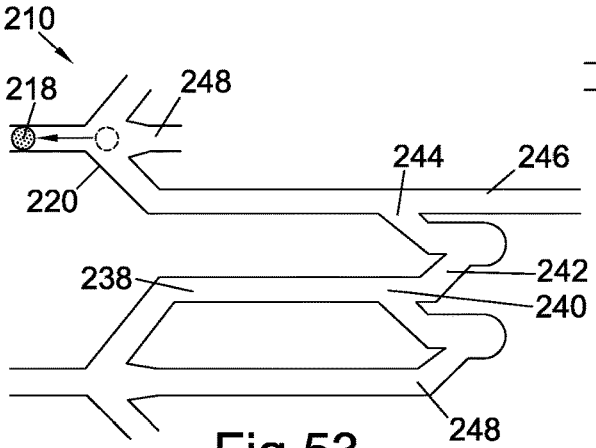
FIG. 53 shows the two-dimensional or flattened layout of the path of FIG. 38 with the actuator in the neutral, starting, return or no-flow actuator position corresponding to that of FIG. 48.

As can be seen when comparing FIG. 48 or 53 with FIG. 39 (or FIG. 43), the pin 218 may be returned to a return actuator position laterally adjacent the start actuator position. Here, the optionally selectable return positions of FIGS. 48 and 53 are of similar longitudinal or axial position to the start actuator position of FIG. 38 and the default first return position of FIG. 43. Here, the start actuator position of FIG. 38 and the default first return position of FIG. 43 are merely laterally or circumferentially separated from the optionally selectable return positions of FIGS. 48 and 53 (i.e. the start and return positions are longitudinally aligned and rotationally spaced around the sleeve or mandrel 216). It will be appreciated that here the optionally selectable return positions of FIGS. 48 and 53 correspond to the start position of a second pin (not shown) positioned diametrically opposite the first pin 118. Accordingly, the portion of the slot channel 220 shown in FIG. 38 is repeated around the sleeve or mandrel 216 to define a continuous slot channel 220 around the circumference of the sleeve or mandrel 216. Whereas the embodiment 110 of FIGS. 2 to 37 can continuously cycle by repeatedly oscillating in rotational and axial directions, the embodiment of FIGS. 38 to 53 may endlessly cycle by repeatedly oscillating in rotational direction between the positions of FIGS. 39 and 40 and/or may endlessly cycle by repeatedly progressively rotating in a continuous direction of rotation. In both of these embodiments 110, 210, the actuator 110, 210 may be endlessly cycled by reversing an axial direction of movement of the sleeve or mandrel 116, 216.

As can be seen in FIG. 38, the return portions of each of the primary, secondary paths 238, 242, provide identical windows, such as for selectively accessing the secondary or further secondary paths 242, 246. Compared to the embodiment of FIGS. 2 to 37, the embodiment of FIG. 38 to FIG. 53 may require a shorter axial length for the slot channel 220 providing a generally similar functionality. For example, comparing the similar window portions 150, 250, it can be seen that the return portion of the secondary path 146 of FIG. 19 comprises a section towards the return position beyond (to the right of) the window portion 150, which is not required in the embodiment of FIG. 38.

In both of these examples, there is provided an intermediate actuator position (second short stroke position), such that the selective downhole actuator is transitionable to an actuating position by varying the operating parameters appropriately during the two sequential windows. Indexing the selective downhole actuator 110, 210 to the activating position requiring at least two sequential variations of the operating parameter according to a predetermined pattern, sequence or procedure provides a failsafe or an additional reassurance that the likelihood or risk of undesired indexing towards an actuated actuator state (e.g. of the third actuator position) is reduced. For example, in the event that the pumps temporarily fail or are inadvertently temporarily turned off, or there is an unrelated drop in fluid pressure (e.g. a valve or other restriction opening or closing), then the selective downhole actuator 110, 210 is not necessarily be indexed to an activating position as soon as the fluid pressure is restored, such as due to the re-engagement of the pumps or the reversal of the valve or other restriction.

However, it will be readily be appreciated that other embodiments may comprise no intermediate positions, or more intermediate positions, such that the number of required sequential variations of the operating parameter/s may be predetermined as desired. The number of intermediate positions may be varied by adjusting the slot channel 120, 220 pattern.

Figure 54:
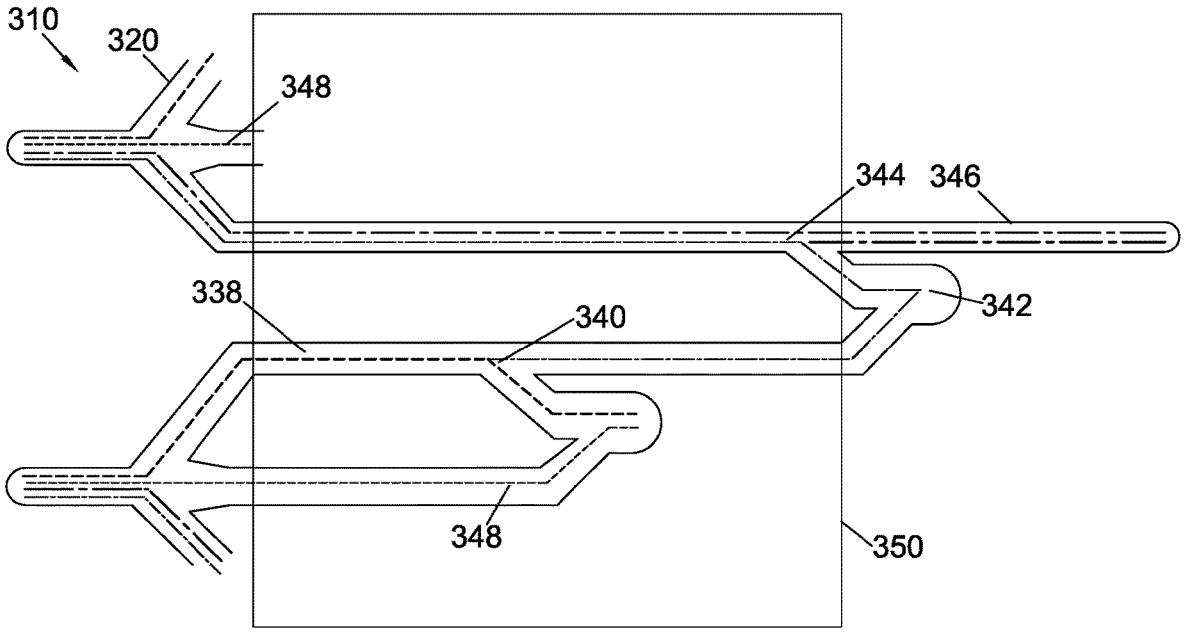
FIG. 54 shows a two-dimensional or flattened layout of a path of another selective downhole actuator, indicating a damping zone or phase.

FIG. 54 shows an alternative slot channel 320 generally similar to that of the slot channel 220 of FIG. 38, with similar features denoted by similar reference numerals, incremented by 100. Accordingly, the slot channel comprises a primary path 338 and a first intersection 340. As shown here, the direction of fluid pressure force and also of spring bias are the same as FIG. 38 (i.e. the fluid pressure force acts to propel the sleeve or mandrel to the left, whilst the spring—not shown here—acts to propel the mandrel or sleeve to the right).

As shown here, the intermediate position corresponds to a different actuator state. Here, the third actuator position corresponds to a first actuation actuator state, such as a long piston stroke position; and the intermediate position corresponds to an intermediate actuating actuator state, such as an intermediate piston stroke position. Accordingly, it may be possible to hold or maintain the selective downhole actuator 310 in an intermediate actuating actuator state, such as when the operating parameter is maintained at a first value. Such a selective downhole actuator 310 may enable the extension or maintenance of a piston at two stroke lengths, such as to provide two active actuating positions or states. For example, such an actuator 310 may enable operations at at least two different operating parameters (e.g. reaming or under-reaming at two or more different diameters). It will be appreciated that the relative axial positions of the intermediate and third actuator positions may be predetermined to provide predetermined axial translations of the sleeve or mandrel in the respective actuation states.

It will be appreciated that, as shown in FIG. 54, the selective downhole actuator 310 is configured to always transition by default to a particular actuation state, whenever subjected to a particular operating parameter condition. Here, the default actuation position comprises a default axial actuation position. It will be appreciated that where a plurality of slot patterns as shown in FIG. 54 are repeated around the circumference of a sleeve or mandrel (e.g. two such slot patterns overlapping and connected, with two corresponding guide pins), then the default actuation position from the intermediate and third actuation positions may be the second actuation position (corresponding to the initial or starting position) of the adjacent slot pattern. Accordingly, the actuator 310 returns to a particular default position of the plurality of default positions dependent upon the actuation position from where the actuator 310 is transitioning under the default conditions. For example, where the actuator 310 is defaulting to a non-actuating state under no flow or low fluid pressure from the first actuation position, the actuator 310 defaults to the second actuation position (the initial or starting position as shown here); and where the actuator 310 is defaulting to a non-actuating state under no flow or low fluid pressure from the intermediate and third actuation positions, the actuator 310 defaults to a further second actuation position, rotationally arranged relative to the initial or starting second position.

Figure 55:
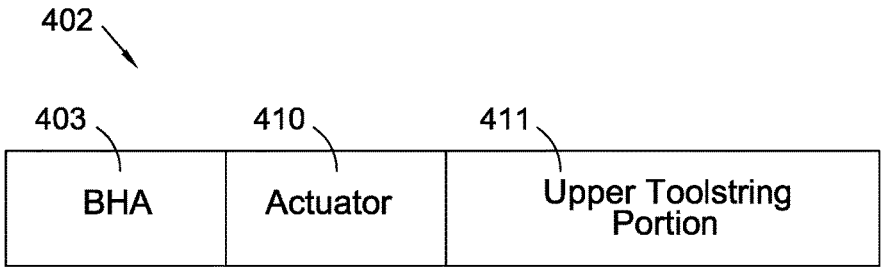
FIG. 55 shows a schematic representation of a further toolstring comprising an embodiment of a selective downhole actuator.

FIG. 55 shows a schematic representation of a further toolstring 402 comprising an embodiment of a selective downhole actuator 410. The toolstring schematically shown is generally similar to that of FIG. 1. However, here the actuator 410 is located uphole of the BHA, connected to an upper toolstring portion 411. It will be appreciated that the actuator 410 may be used for the actuation of one or more associated tools or functions (not shown). It will also be appreciated, that the toolstring 402 may comprise a plurality of actuators 410 according to the present invention. In addition, or alternatively, the toolstring 402 may comprise one or more additional actuators (not shown) such as one or more conventional actuators.

Figure 56:
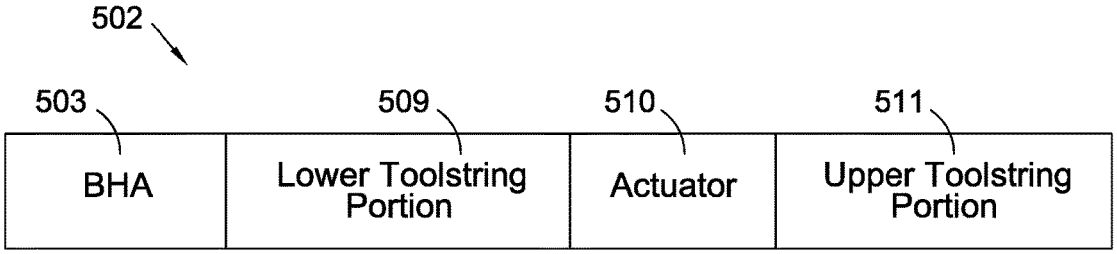
FIG. 56 shows a schematic representation of a yet further toolstring comprising an embodiment of a selective downhole actuator.

FIG. 56 shows a schematic representation of a yet further toolstring 502 comprising an embodiment of a selective downhole actuator 510. Here, the actuator 510 is shown at an intermediate portion of the toolstring 502, between a lower toolstring portion 509 and an upper toolstring portion 511. It will again be appreciated that the actuator 510 may be used for the selective actuation of one or more associated tools or functions (not shown). It will also be appreciated that the toolstring 502 may comprise one or more additional actuators, such as one or more actuators according to the present application and/or conventional actuator/s. For example, the BHA 503 may comprise one or more additional actuators (not shown).

It will be appreciated that the actuator of the present application may find utility in or at various locations along or within a toolstring, such as according to particular functional requirements of particular toolstrings.

It will be apparent to those of skill in the art that the above described embodiments are merely exemplary of the present invention, and that various modifications and improvements may be made thereto, without departing from the scope of the invention. For example, it will also be appreciated that in other embodiments, a toolstring comprises a plurality of selective downhole actuators, each selective downhole actuator being configured to actuate and/or deactuate an associated tool. The window portions and the slot channel patterns of each of the tools may be similar such that the plurality of tools may be actuatable simultaneously according to a similar variation in the operating parameters. Alternatively, the windows and/or the slot patterns may be different such that the respective associated downhole tolls may be actuated according to different predetermined variations in operating parameters. For example, a first actuator may require two re-engagement of pumps within two successive time windows of between two and four minutes; whereas a second actuator may require two re-engagement of pumps within two successive time windows of between six and eight minutes. Accordingly, each of the actuators may be independently actuated in the string. The windows may be varied by providing different damped lengths of return stroke, or different fluids or restrictions in an associated cylinder chamber. Alternatively, two actuators may be provided with identical windows, whereas a first of the two actuators may comprise one intermediate non-actuating short-stroke position, whilst a second of the two actuators may comprise two intermediate non-actuating short-stroke positions. Accordingly, a first tool associated with the first actuator may be actuated by two sequential re-engagements and both the first and a second tool may be actuated by three successive re-engagements of pumps during the windows.

It will be appreciated that any of the aforementioned tools 110, 210 may have other functions in addition to the mentioned functions, and that these functions may be performed by the same tool 110, 210.

Where some of the above apparatus and methods have been described in relation to actuating an underreaming tool 6; it will readily be appreciated that a similar actuator 10, 110, 210 may be for use with other downhole tools, such as for actuating drilling, cleaning, and/or injection tools, or valves or the like.

Where features have been described as downhole or uphole; or proximal or distal with respect to each other, the skilled person will appreciate that such expressions may be interchanged where appropriate. For example, the skilled person will appreciate that where the sleeve or mandrel extends downhole to actuate; in an alternative embodiment, the sleeve or mandrel may be extended uphole to actuate.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A downhole actuator comprising at least a first actuator position, a second actuator position and a third actuator position, wherein the downhole actuator is fluid-actuated and is reconfigurable between the first actuator position and the second actuator position, and the downhole actuator is selectively reconfigurable to the third actuator position by increasing a fluid flow through or a fluid pressure within the downhole actuator during a transition of the downhole actuator between the first and second actuator positions;

wherein at least a portion of a stroke of the actuator in at least one axial direction is damped, the damping comprising viscous damping provided by a choke;

wherein the downhole actuator further comprises a passageway comprising a throughbore; wherein the choke is located in a chamber sealed from the throughbore.

2. The downhole actuator of claim 1, wherein the actuator comprises a downhole indexer such that the first, second and third actuator positions comprise first, second and third indexing positions respectively, and wherein being selectively reconfigurable comprises being selectively indexable.

3. The downhole actuator of claim 1, wherein at least one of:

the downhole actuator is selectively reconfigurable to the third actuator position only by increasing the fluid flow through or the fluid pressure within the downhole actuator during the transition of the downhole actuator between the first and second actuator positions;

the downhole actuator is selectively reconfigurable to the third actuator position by selectively varying the operating parameter during the transition according to a first predetermined pattern, sequence or procedure; and the downhole actuator is cyclable between the first and second positions and only reconfigurable to the third position upon the active selection of the third actuator position.

4. The downhole actuator of claim 1, wherein the downhole actuator is configured to always transition by default to a particular actuation state whenever subjected to a particular operating parameter condition.

5. The downhole actuator of claim 4, wherein at least one of:

the default actuation state corresponds to a default actuation position, the default actuation position comprising a default axial and/or rotational actuation position; and the default actuation state comprises a non-actuating default state.

6. The downhole actuator of claim 5, wherein at least one of:

the actuator comprises a single default actuation position, the actuator always returning to same actuation position whenever subjected to the default operating parameter condition; and the actuator comprises a plurality of default actuation positions, each comprising a same axial position.

7. The downhole actuator of claim 1, wherein at least one of:

the third actuator position comprises an optional actuator position, selectable by the selective variation of an operating parameter;

the first actuator position comprises a non-actuating position;

the second actuator position comprises a non-actuating position;

the second actuator position corresponds to a neutral, starting, return or no-flow or low-flow position;

the third actuator position comprises an actuating position;

the first actuator position corresponds to a first short stroke position, the second actuator position corresponds to a no-stroke and/or return stroke position; and the third actuator position corresponds to a long stroke position.

8. The downhole actuator of claim 1, wherein the downhole actuator is selectively reconfigurable to the third actuator position by increasing the fluid flow through or the fluid pressure within the downhole actuator during a particular phase or portion of the transition from the first actuator position to the second actuator position, the particular phase or portion corresponding to a window, such as a time and/or travel window.

9. The downhole actuator of claim 8, wherein at least one of:

the transition from the first actuator position to the second actuator position is extended or prolonged; and at least a portion of at least the transition from the first actuator position to the second actuator position is damped.

10. The downhole actuator of claim 8, wherein the downhole actuator comprises:

a primary path defining the transition from the first position to the second position; and a secondary path defining or at least providing access to the third actuator position;

wherein the primary path comprises a junction or intersection for accessing the secondary path during the window portion of transition along the primary path from the first actuator position towards the second actuator position.

11. The downhole actuator of claim 10, wherein at least one of:

the secondary path is accessible by reversing at least a portion of the transition along the primary path; and the downhole actuator comprises a main path between the second actuator position and the first actuator position, the main path and the primary path defining a circuit, the main path comprising a stroking or extension path from the second actuator position to the first actuator position, and the primary path comprising a return path from the first actuator position to the second actuator position.

12. The downhole actuator of claim 10, wherein a prolonged or extended window comprises sufficient time to distinguishably establish variation in the operating parameters.

13. The downhole actuator of claim 12, wherein the window provides for sufficient time and/or travel to sufficiently decrease fluid pressure and/or flow to transition along at least a portion of the primary path and then to sufficiently increase fluid pressure and/or flow to reverse transition along the at least a portion of the primary path, such as to access the secondary path.

14. The downhole actuator of claim 10, wherein the third actuator position is indirectly accessible from the first actuator position via the primary path, via a fourth actuator position, wherein the fourth actuator position is an intermediate actuator position between the first actuator position and the third actuator position.

15. The downhole actuator of claim 14, wherein the intermediate actuator position defines an additional pattern, sequence or procedure or a repetition of the first pattern, sequence or procedure, in order to access or index to the third actuator position, the downhole actuator being selectively reconfigurable to the intermediate actuator position by varying an operating parameter during a transition of the downhole actuator between the first and second actuator positions.

16. The downhole actuator of claim 1, wherein at least one of:

the downhole actuator is cyclable between the first and second actuator positions by moving in opposite axial and/or rotational directions;

the downhole actuator is configured to alternate or oscillate rotational direction during sequential indexing; and the downhole actuator is configured to continually or continuously rotate in substantially the same direction during sequential sequencing.

17. The downhole actuator of claim 1, wherein the downhole downhole actuator is reconfigurable from the first actuator position to the second actuator position by setting an operating parameter at a first value; the downhole downhole actuator is reconfigurable from the second actuator position to the first actuator position by setting the operating parameter at a second value, the downhole downhole actuator being reconfigurable from the second actuator position to the first actuator position by varying the operating parameter to the second value; and the downhole actuator being reconfigurable from the first actuator position to the third actuator position by setting the operating parameter at a third value during the transition from the first actuator position towards the second actuator position.

18. The downhole actuator of claim 1, wherein the downhole actuator comprises a piston, the piston being axially urged or moved according to a pressure differential acting across the piston.

19. A downhole tool comprising the downhole actuator of claim 1.

20. A tool string comprising the downhole actuator of claim 1.

21. A method of downhole actuation, the method comprising reconfiguring a downhole actuator between at least a first actuator position, a second actuator position and a third actuator position, wherein the method comprises:

reconfiguring the downhole actuator from the first actuator position towards the second actuator position; and selectively reconfiguring the downhole actuator to the third actuator position by increasing the fluid flow through or the fluid pressure within the downhole actuator during a transition of the downhole actuator between the first and second actuator positions;

wherein at least a portion of a stroke of the actuator in at least one axial direction is damped, the damping comprising viscous damping provided by a choke;

wherein the downhole actuator is fluid-actuated and further comprises a passageway comprising a throughbore; wherein the choke is located in a chamber sealed from the throughbore.

22. The method of claim 21, wherein the method comprises indexing a downhole selective downhole indexer, the first, second and third actuator positions comprising first, second and third indexing positions respectively.

23. The method of claim 21, wherein at least one of:

selectively reconfiguring to the third actuator position is only achievable by increasing the fluid flow through or the fluid pressure within the downhole actuator during the transition of the downhole actuator between the first and second actuator positions:

the operating parameter is selectively varied during the transition according to a first predetermined pattern, sequence or procedure; and indexing or reconfiguring the downhole actuator to the activating position comprises or requires varying the operating parameter at least twice sequentially according to a predetermined pattern, sequence or procedure.

24. The method of claim 21, wherein the method comprises always transitioning by default to a particular actuation state whenever the actuator subjected to a particular operating parameter condition.

* * * * *